US008400356B2

(12) United States Patent
Paynter

(10) Patent No.: US 8,400,356 B2
(45) Date of Patent: Mar. 19, 2013

(54) DIRECTIVE SPATIAL INTERFERENCE BEAM CONTROL

(75) Inventor: Scott J. Paynter, Grand Prairie, TX (US)

(73) Assignee: Lockheed Martin Corp., Bethesda, MD (US)

( * ) Notice: Subject to any disclaimer, the term of this patent is extended or adjusted under 35 U.S.C. 154(b) by 470 days.

(21) Appl. No.: 12/459,523

(22) Filed: Jul. 2, 2009

(65) Prior Publication Data

US 2010/0013708 A1 Jan. 21, 2010

Related U.S. Application Data

(63) Continuation-in-part of application No. 11/956,825, filed on Dec. 14, 2007, now abandoned.

(60) Provisional application No. 60/882,049, filed on Dec. 27, 2006.

(51) Int. Cl.
*H01Q 3/26* (2006.01)

(52) U.S. Cl. ..... 342/377; 342/372

(58) Field of Classification Search ..... 342/372, 342/368, 374–375, 377
See application file for complete search history.

(56) References Cited

U.S. PATENT DOCUMENTS

| | | | | |
|---|---|---|---|---|
| 3,393,400 | A | 7/1968 | Trott | |
| 3,471,864 | A | 10/1969 | Kummer | 342/368 |
| 3,725,929 | A * | 4/1973 | Spanos | 342/372 |
| 4,063,250 | A | 12/1977 | Fenwick | 343/844 |
| 4,425,567 | A * | 1/1984 | Tresselt | 342/373 |
| 5,134,416 | A | 7/1992 | Cafarelli et al. | 342/372 |
| 5,345,246 | A | 9/1994 | Sezai | 342/368 |
| 5,359,334 | A | 10/1994 | Gutman | 342/408 |
| 5,396,256 | A | 3/1995 | Chiba et al. | 342/372 |
| 5,694,498 | A | 12/1997 | Manasson et al. | 385/15 |
| 5,796,881 | A | 8/1998 | Manasson et al. | 385/9 |
| 5,864,317 | A | 1/1999 | Boe et al. | 342/374 |
| 6,061,035 | A | 5/2000 | Kinasewitz | 343/853 |
| 6,097,267 | A | 8/2000 | Hampel | 333/128 |
| 6,184,828 | B1 | 2/2001 | Shoki | 342/372 |
| 6,535,168 | B1 | 3/2003 | Marumoto et al. | 343/700 |
| 6,559,737 | B1 | 5/2003 | Nagra et al. | 333/156 |
| 6,608,595 | B1 | 8/2003 | Louzir | 343/700 |
| 6,788,250 | B2 * | 9/2004 | Howell | 342/377 |
| 6,950,590 | B2 | 9/2005 | Cheung et al. | 385/129 |
| 7,170,446 | B1 | 1/2007 | West et al. | 342/372 |
| 2001/0020918 | A1 | 9/2001 | Takai | 343/729 |

(Continued)

FOREIGN PATENT DOCUMENTS

| | | |
|---|---|---|
| EP | 1 357 637 A2 | 10/2003 |
| GB | 2 243 491 A | 10/1991 |

(Continued)

OTHER PUBLICATIONS

Borgioli et al., *Low-Loss Distributed MEMS Phase Shifter*, IEEE Microwave and Guided Wave Letters, vol. 10, No. 1. Jan. 2000.

(Continued)

*Primary Examiner* — Jack W Keith
*Assistant Examiner* — Fred H Mull
(74) *Attorney, Agent, or Firm* — Lee, Jorgensen, Pyle & Kewalramani, P.C.

(57) ABSTRACT

The invention, in its various aspects and embodiments, comprises a variety methods and apparatuses. The methods variously determine the delay (or phase shift) in each element of a phased array to simultaneously form, steer and/or combine a set of beam shapes. The apparatuses include apparatuses that implement the methods as well as apparatuses that employ such methods. The invention also includes a beam controlled by such methods.

64 Claims, 36 Drawing Sheets

U.S. PATENT DOCUMENTS

| | | | | |
|---|---|---|---|---|
| 2003/0043085 | A1 | 3/2003 | Park et al. | 343/770 |
| 2004/0174300 | A1 | 9/2004 | Nakagawa | 342/377 |
| 2005/0206564 | A1 | 9/2005 | Mao | 342/377 |
| 2006/0135062 | A1 * | 6/2006 | Takai | 455/25 |
| 2006/0273972 | A1 | 12/2006 | Chandler | 343/754 |
| 2009/0160707 | A1 * | 6/2009 | Lakkis | 342/368 |

FOREIGN PATENT DOCUMENTS

| | | | |
|---|---|---|---|
| GB | 2407920 | A | 5/2005 |
| GB | 2 076 225 | A | 5/2007 |
| JP | 10-32868 | A * | 10/1998 |
| WO | WO03017422 | A1 | 2/2003 |
| WO | WO2006130795 | A3 | 7/2006 |
| WO | WO2008082197 | A2 | 7/2008 |

OTHER PUBLICATIONS

Gregorwich et al., "*A multibeam phased array for aircraft*", Aerospace Applications Conference. 1996. Proceedings, 1996 IEEE Aspen Col., vol. 1, pp. 151-156.

Hall et al, *Microstrip Patch Array with Multiple Beams*, School of Electrical Engineering and Science, Royal Military College of Science, UK.

Hansen, Robert C., "Phased Array Antennas (1998) XP002407648".

Johnson et al., *Phased Arrays*, in Antenna Engineering Handbook, 3rd Ed., edited by R.C. Johnson. McGraw-Hill, Inc.. p. 20-1 to 20-2, 1993.

Kingsley et al., 14GHZ MEMS 4-bit Phase Shifter on Silicon (2004) Silicon Monolithic Integrated Circuits in RF Systems; Digest of Papers; 2004 Topical Meeting Atlanta, GA; IEEE, Sep. 8, 2004 pp. 326-328.

Mailloux et al., *Phased Array Antenna Handbook*, Artech House, Inc., p. 1 and 17-19, 1994.

Mouhamadou, M. and Vaudon, P., "*Smart Antenna Array Patterns Synthesis: Null Steering and Multi-User Beamforming By Phase Control*", Progress in Electronics Research, PIER 60, 05-106, 2006.

Nylund et al., "*Digitally Controlled 10.5 GHZ Complex Weight Circuit for Null Steering Arrays*", published Aug. 24, 1992.

International Search Report for PCT/US2006/021341 mailed Jan. 18, 2007.

International Search Report for PCT/US2007/87577 mailed Aug. 5, 2008.

Partial Search Report for PCT/US2007/87577 mailed May 26, 2008.

Specification, Claims, Abstract, Drawings, Appendices for U.S. Appl. No. 60/882,049, filed Dec. 27, 2006.

Specification, Claims, Abstract, Drawings_Declaration for U.S. Appl. No. 11/421,504, filed Jun. 1, 2006.

Non-Final Rejection dated May 14, 2007 for U.S. Appl. No. 11/421,504.

Non-Final Rejection dated Oct. 15, 2007 for U.S. Appl. No. 11/421,504.

Final Rejection dated Jun. 27, 2008 for U.S. Appl. No. 11/421,504.

Advisory Action dated Sep. 10, 2008 for U.S. Appl. No. 11/421,504.

Notice of Allowance and Fees Due for U.S. Appl. No. 11/421,504, Jan. 12, 2009.

Issue Notification dated Apr. 22, 2009 for U.S. Appl. No. 11/421,504.

* cited by examiner

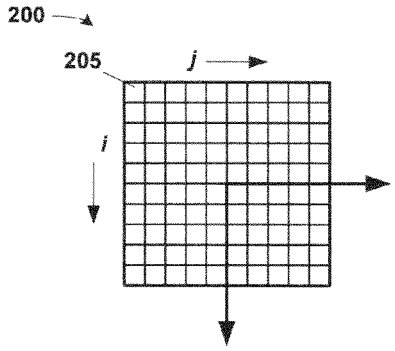
FIG. 2
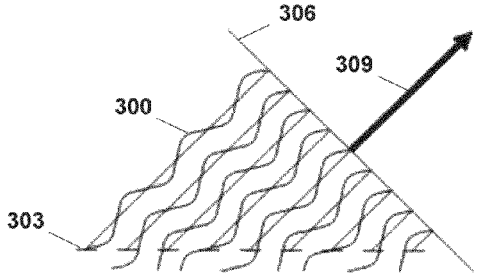
FIG. 3
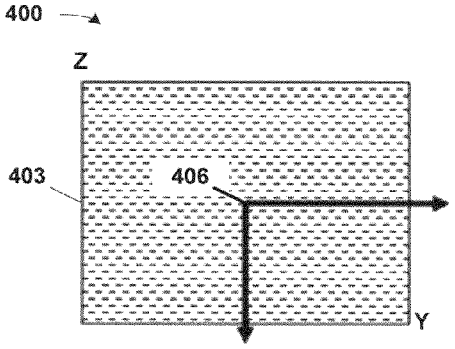
FIG. 4
$F=[f_{i,j}]$
| | | | | | | | | | |
|---|---|---|---|---|---|---|---|---|---|
| 9 | 8 | 7 | 6 | 5 | 5 | 6 | 7 | 8 | 9 |
| 8 | 7 | 6 | 5 | 4 | 4 | 5 | 6 | 7 | 8 |
| 7 | 6 | 5 | 4 | 3 | 3 | 4 | 5 | 6 | 7 |
| 6 | 5 | 4 | 3 | 2 | 2 | 3 | 4 | 5 | 6 |
| 5 | 4 | 3 | 2 | 1 | 1 | 2 | 3 | 4 | 5 |
| 5 | 4 | 3 | 2 | 1 | 1 | 2 | 3 | 4 | 5 |
| 6 | 5 | 4 | 3 | 2 | 2 | 3 | 4 | 5 | 6 |
| 7 | 6 | 5 | 4 | 3 | 3 | 4 | 5 | 6 | 7 |
| 8 | 7 | 6 | 5 | 4 | 4 | 5 | 6 | 7 | 8 |
| 9 | 8 | 7 | 6 | 5 | 5 | 6 | 7 | 8 | 9 |
FIG. 5A
$Y=[y_{i,j}]$
| | | | | | | | | | |
|---|---|---|---|---|---|---|---|---|---|
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
| -4.5 | -3.5 | -2.5 | -1.5 | -0.5 | 0.5 | 1.5 | 2.5 | 3.5 | 4.5 |
FIG. 5B $Z=[z_{i,j}]$
| | | | | | | | | | |
|---|---|---|---|---|---|---|---|---|---|
| -4.5 | -4.5 | -4.5 | -4.5 | -4.5 | -4.5 | -4.5 | -4.5 | -4.5 | -4.5 |
| -3.5 | -3.5 | -3.5 | -3.5 | -3.5 | -3.5 | -3.5 | -3.5 | -3.5 | -3.5 |
| -2.5 | -2.5 | -2.5 | -2.5 | -2.5 | -2.5 | -2.5 | -2.5 | -2.5 | -2.5 |
| -1.5 | -1.5 | -1.5 | -1.5 | -1.5 | -1.5 | -1.5 | -1.5 | -1.5 | -1.5 |
| -0.5 | -0.5 | -0.5 | -0.5 | -0.5 | -0.5 | -0.5 | -0.5 | -0.5 | -0.5 |
| 0.5 | 0.5 | 0.5 | 0.5 | 0.5 | 0.5 | 0.5 | 0.5 | 0.5 | 0.5 |
| 1.5 | 1.5 | 1.5 | 1.5 | 1.5 | 1.5 | 1.5 | 1.5 | 1.5 | 1.5 |
| 2.5 | 2.5 | 2.5 | 2.5 | 2.5 | 2.5 | 2.5 | 2.5 | 2.5 | 2.5 |
| 3.5 | 3.5 | 3.5 | 3.5 | 3.5 | 3.5 | 3.5 | 3.5 | 3.5 | 3.5 |
| 4.5 | 4.5 | 4.5 | 4.5 | 4.5 | 4.5 | 4.5 | 4.5 | 4.5 | 4.5 |
FIG. 5C
$S=[s_{i,j}]$
| | | | | | | | | | |
|---|---|---|---|---|---|---|---|---|---|
| 1 | 1 | 1 | 0 | 0 | 0 | 0 | 1 | 1 | 1 |
| 1 | 1 | 0 | 0 | 0 | 0 | 0 | 0 | 1 | 1 |
| 1 | 0 | 0 | 0 | 1 | 1 | 0 | 0 | 0 | 1 |
| 0 | 0 | 0 | 1 | 1 | 1 | 1 | 0 | 0 | 0 |
| 0 | 0 | 1 | 1 | 1 | 1 | 1 | 1 | 0 | 0 |
| 0 | 0 | 1 | 1 | 1 | 1 | 1 | 1 | 0 | 0 |
| 0 | 0 | 0 | 1 | 1 | 1 | 1 | 0 | 0 | 0 |
| 1 | 0 | 0 | 0 | 1 | 1 | 0 | 0 | 0 | 1 |
| 1 | 1 | 0 | 0 | 0 | 0 | 0 | 0 | 1 | 1 |
| 1 | 1 | 1 | 0 | 0 | 0 | 0 | 1 | 1 | 1 |
FIG. 6A
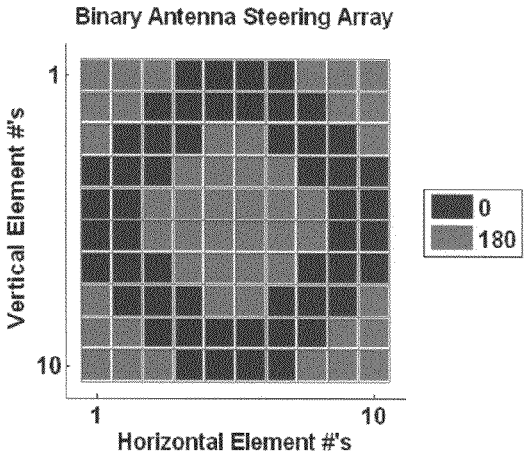
FIG. 6B
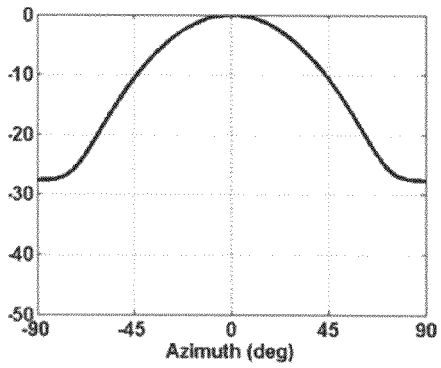
FIG. 6C

| | | | | | | | | | |
|---|---|---|---|---|---|---|---|---|---|
| 306 | 252 | 198 | 324 | 270 | 270 | 324 | 198 | 252 | 306 |
| 252 | 198 | 324 | 270 | 216 | 216 | 270 | 324 | 198 | 252 |
| 198 | 324 | 270 | 216 | 342 | 342 | 216 | 270 | 324 | 198 |
| 324 | 270 | 216 | 342 | 288 | 288 | 342 | 216 | 270 | 324 |
| 270 | 216 | 342 | 288 | 234 | 234 | 288 | 342 | 216 | 270 |
| 270 | 216 | 342 | 288 | 234 | 234 | 288 | 342 | 216 | 270 |
| 324 | 270 | 216 | 342 | 288 | 288 | 342 | 216 | 270 | 324 |
| 198 | 324 | 270 | 216 | 342 | 342 | 216 | 270 | 324 | 198 |
| 252 | 198 | 324 | 270 | 216 | 216 | 270 | 324 | 198 | 252 |
| 306 | 252 | 198 | 324 | 270 | 270 | 324 | 198 | 252 | 306 |

| | | | | | | | | | |
|---|---|---|---|---|---|---|---|---|---|
| 180 | 180 | 180 | 0 | 0 | 0 | 0 | 180 | 180 | 180 |
| 180 | 180 | 0 | 0 | 0 | 0 | 0 | 0 | 180 | 180 |
| 180 | 0 | 0 | 0 | 180 | 180 | 0 | 0 | 0 | 180 |
| 0 | 0 | 0 | 180 | 180 | 180 | 180 | 0 | 0 | 0 |
| 0 | 0 | 180 | 180 | 180 | 180 | 180 | 180 | 0 | 0 |
| 0 | 0 | 180 | 180 | 180 | 180 | 180 | 180 | 0 | 0 |
| 0 | 0 | 0 | 180 | 180 | 180 | 180 | 0 | 0 | 0 |
| 180 | 0 | 0 | 0 | 180 | 180 | 0 | 0 | 0 | 180 |
| 180 | 180 | 0 | 0 | 0 | 0 | 0 | 0 | 180 | 180 |
| 180 | 180 | 180 | 0 | 0 | 0 | 0 | 180 | 180 | 180 |
FIG. 6F
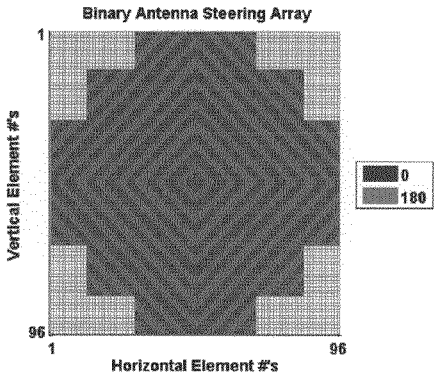
FIG. 7
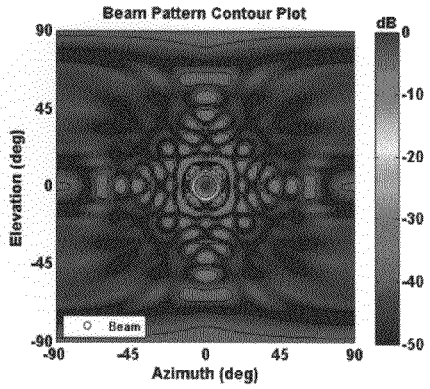
FIG. 8
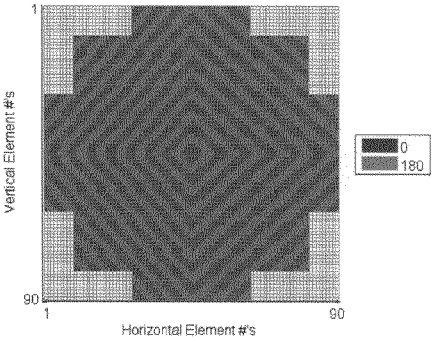
FIG. 9
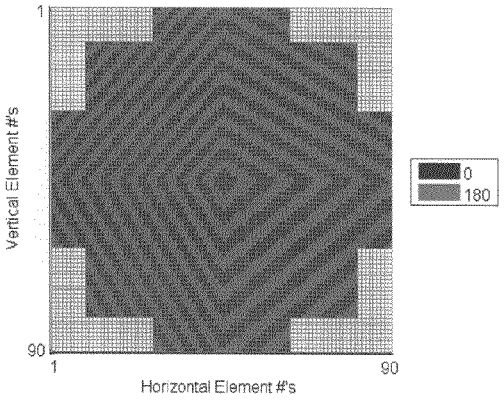
FIG. 10

DIRECTIVE SPATIAL INTERFERENCE BEAM CONTROL

This is a continuation-in-part of co-pending U.S. application Ser. No. 11/956,825, entitled, "Directive Spatial Interference Beam Control", and filed Dec. 14, 2007, in the name of the inventor Scott J. Paynter, and now abandoned. The earlier effective filing date of this application is hereby claimed under 35 U.S.C. §120 for all common subject matter. This application is also hereby incorporated by reference for all purposes as if set forth herein verbatim.

The earlier effective filing date of U.S. Provisional Application Ser. No. 60/882,049; entitled, "Directive Spatial Interference Beam Control"; filed Dec. 27, 2006, filed in the name of the inventor Scott J. Paynter. This application is also hereby incorporated by reference for all purposes as if set forth herein verbatim.

FIELD OF THE INVENTION

1. Field of the Invention

The present invention pertains to beam steering, and, more particularly, to a directive spatial interference beam control.

2. Description of the Related Art

Beam forming and beam steering in phased arrays are known. Beam forming and beam steering could be described as a diffraction (or interference) pattern that concentrates transmitted energy in a specified direction. To form a beam is to focus the energy in a direction. To steer the beam is to be able to control which direction the energy is focused and to be able to change that direction. Some beams are steered using mechanical gimbals to physically change the orientation of the antenna. Some beams are steered electronically, where the phase angles of the radiating elements are adjusted to alter the diffraction pattern and thus change the direction of focused energy. A phased array has numerous radiating elements, which are point sources of wave energy. The diffraction pattern shows how the combined wave energies interfere (both constructively and destructively) in all directions.

In a phased array, in order to steer a beam (or form a beam for that matter), we want the phases of the waves coming from each element to be as much in-phase as possible in the direction that we want the beam to point. For phased arrays with phase shifters that have infinite resolution, it is not difficult to select the phase shift required by each element to align the phases of the waves in the desired direction. With phase shifters that have "n-bit" resolution, the desired phase angles in each phase shifter must be rounded to the closest achievable phase angle. With a 1-bit phase shifter, the desired phase angles are rounded to either 0° or 180°.

Adaptive processing algorithms process beam return data to create virtual nulls in an altered beam pattern. Most adaptive processing algorithms require significant computer resources to store and manipulate large amounts of data.

The present invention is directed to resolving, or at least reducing, one or all of the problems mentioned above.

SUMMARY OF THE INVENTION

The invention, in its various aspects and embodiments, comprises a variety of methods and apparatuses. The methods variously determine the delay (or phase shift) in each element of a phased array to simultaneously form, steer and/or combine a set of beam shapes. The apparatuses include apparatuses that implement the methods as well as apparatuses that employ such methods. The invention also includes a beam controlled by such methods.

BRIEF DESCRIPTION OF THE DRAWINGS

The invention may be understood by reference to the following description taken in conjunction with the accompanying drawings, in which like reference numerals identify like elements, and in which:

FIG. 2 establishes a set of references for describing phase shifter selection functions for a given phase array comprised of a plurality of phase shifters;

FIG. 3 conceptually depicts an in-phase wavefront in the direction of the main beam of a steered beam;

FIG. 4 establishes a phase array coordinate frame looking forward through the array;

FIG. 5A-FIG. 5C illustrate the central portion of the $f_{i,j}$ array, the central portion of the $y_{i,j}$ array, and the central portion of the $z_{i,j}$ array of a centrally fed structure in a first particular embodiment;

FIG. 6A-FIG. 6F illustrates assorted characteristics of a second particular embodiment;

FIG. 7 depicts a steering beam pattern for forming beam along boresight;

FIG. 8 depicts a 2-D beam pattern contour plot for a beam steered along boresight;

FIG. 9 depicts a steering beam pattern for forming a beam along 15° azimuth and 0° elevation;

FIG. 10 depicts a steering beam pattern for forming a beam along 30° azimuth and −15° elevation;

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The present invention presents a method and apparatus for determining and implementing the delay (or phase shift) in each element of a phased array to simultaneously form, steer and combine a set of beam shapes. In this manner, the present invention controls a beam shape created by an electronically steered phased array. One particular embodiment is generally, and graphically, illustrated in FIG. 1. This technique for control of the beam shape includes forming a main beam lobe in a desired direction while potentially suppressing the broadcast signal in a separate direction. Most of this invention deals with array elements with 1-bit phase shifters and element spacing less than ⅓ wavelength.

Figure 1:
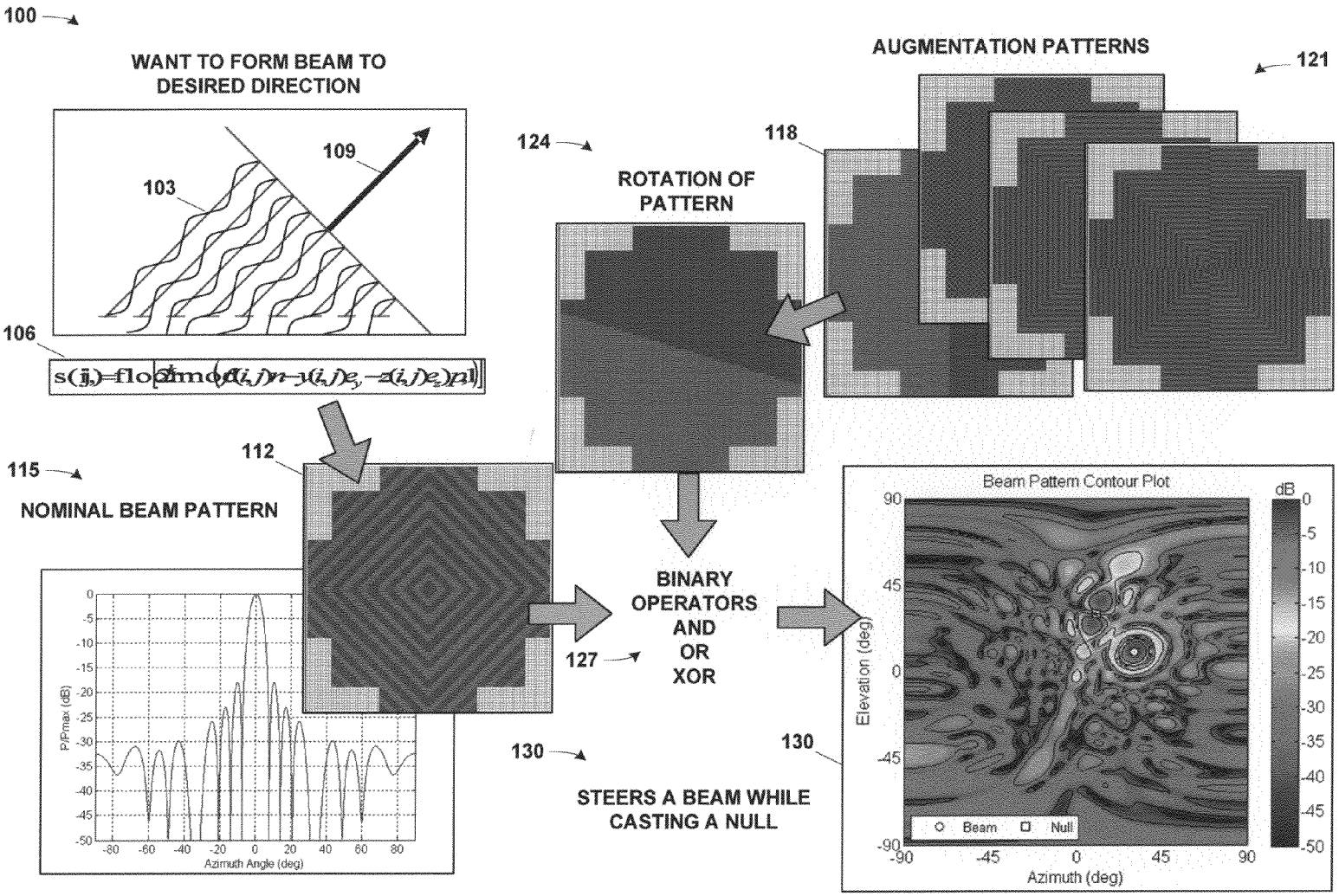
FIG. 1 graphically illustrates a method in accordance with the present invention that controls a beam shape created by an electronically steered phased array.

As is graphically illustrated in FIG. 1, a method has been developed to steer the main beam for a phased array. For sub-½ wavelength spacing and 1-bit phase shifters, an augmentation technique is produced that steers the main beam, as well as a null (if desired). For 1-bit phase shifters, numerous steering augmentation patterns are created that generate unique modifications to the nominal beam shape. By using AND, OR and XOR binary logic functions of the nominal beam steering pattern and these augmentation patterns, beam shapes are modified, gain levels are changed, nulls are placed. Other augmentations provide broadcast and receive gain control. Multiple beams can be cast which can also create spoiled (wider) beams. The technique could provide adaptive processing capability without the huge computational requirements of traditional systems. The beam steering approach can also be extended to n-bit phase shifters.

This particular technique begins (at 100) with a desire to form a beam 103 defined by the equation 106 in a given direction 109 conceptually illustrated by the arrow graphic. A nominal beam pattern 112 is then defined (at 115). One or more augmentation patterns 118 (only one indicated) are defined (at 121), rotated (at 124), and overlaid (at 127) on the nominal beam pattern 112 using a plurality of binary operators. The resultant beam is then steered while casting a null (at 130), as illustrated by the graph 133. This approach therefore constructs an array of phase shifter commands for each element of the array. The resulting beam steering pattern (i.e., augmentation pattern 118) produces the beam 103 in the desired direction 109.

FIG. 2 establishes a set of references for describing phase shifter selection functions for a given phase array 200 comprised of a plurality of phase shifters 205 (only one indicated). Employing the references established in FIG. 2, suitable functions of phase shifter selection functions include, but are not limited to, for 1-bit phase shifters:

$$s_{i,j}=\text{round}(\text{mod}(p(y_{i,j}e_y+z_{i,j}e_z-f_{i,j}n),1)),\ \text{or}$$

$$s_{i,j}=1-\text{round}(\text{mod}(p(y_{i,j}e_y+z_{i,j}e_z-f_{i,j}n),1)),\ \text{or}$$

$$s_{i,j}=\text{floor}(2\ \text{mod}(p(y_{i,j}e_y+z_{i,j}e_z-f_{i,j}n),1)),\ \text{or}$$

$$s_{i,j}=1-\text{floor}(2\ \text{mod}(p(y_{i,j}e_y+z_{i,j}e_z-f_{i,j}n),1))$$

where:

- $s_{i,j}$ is the phase shift bit of the (i, j) element (either a 0 or a 1; 0 for no shift and 1 for 180° shift) and is an integer value from 0 to $2^k-1$;
- p is the element spacing in numbers of wavelengths;
- $f_{i,j}$ is the feed structure length from the reference point to the (i, j) element of the array in number of element spacings;
- n is the dielectric constant of the feed structure material;
- $y_{i,j}$ is the horizontal position of the (i, j) element (in number of spacings), relative to the reference point of the array (each element is 1 spacing from its horizontal neighbors);
- $z_{i,j}$ is the vertical position of the (i, j) element (in number of spacings), relative to the reference point of the array (each element is 1 spacing from its vertical neighbors);
- mod(a,b)="modulus after division" function(mod(0.9,1)=0.9, mod(10.1,1)=0.1, mod(1,1)=0, mod(3,1)=0; and
- floor(a)=rounds a towards negative infinity (0.99→0, 1.5→1, 3.0→3)
- $e_y$ and $e_z$ are the y- and z-components of the unit vector pointing in the direction that the beam should be steered; and $$\bar{e}_s=\begin{pmatrix} e_x \\ e_y \\ e_z \end{pmatrix}$$

is the desired direction to steer the beam.

For arbitrary k-bit phase shifters:

$$s_{i,j}=\text{floor}(2^k\ \text{mod}(p(y_{i,j}e_y+z_{i,j}e_z-f_{i,j}n),1))$$

where

- $s_{i,j}$ indicates the phase shift of the (i, j) element $$\left(\text{the phase shift would be } 360°\frac{s_{i,j}}{2^k}\right).$$

Note that other suitable functions may be realized by those skilled in the art having the benefit of this disclosure.

In general, and in one aspect, the invention determines a delay pattern for a plurality signals emanating from a respective plurality of radiating elements in a phased array and generating the signals to create a diffraction pattern resulting from the delay pattern. In the delay for the augmentation pattern, the delay for approximately half the radiating elements to 0° and the delay for the remainder of the radiating elements to 180°. The qualification represented by the term "approximately," arises from a couple of considerations. Not all augmentation patterns will necessarily result in a 50/50 halving of the radiating elements between 0° and 180°. For example, an odd number of radiating elements is not amenable to halving and some patterns.

The patterns presented herein also assume that each radiating element in the phased array is operating at the same power level. However, some phased arrays exhibit a well known effect sometimes called "tapering". Tapering results in different radiating elements operating at different power levels. In a common manifestation, radiating elements near the center of the array radiate at a higher power level than do those at the edges of the array.

Thus, in generating the augmentation pattern, the objective of the determined pattern is to radiate approximately half the power of the array at a 0° phase shift and half the power at 180° in the presence of tapering. In the absence of tapering, this will typically—but not always—result in half the radiating elements radiating at a 0° phase shift and half at 180°. However, specific implementations may call for some deviation from the 50/50 allocation.

This approach can cast a beam and null in the broadcast and receive signals rather than relying on onboard computers to process the received signals to artificially produce nulls in desired directions. The adaptive processing, gain control and beam spoiling can all be achieved through combinations of basic beam steering patterns. This approach could also significantly reduce the requirements for on-board computer resources which can require large amounts of power. This could be a low cost alternative to traditional adaptive processing.

A more extended, technical discussion of the principles set forth above will now be presented so as to further an understanding of the present invention. The following discussion addresses steering the main lobe of a phased array and, in some cases, moving side lobes away and nulls into directions where no signal return is desired. Several techniques are disclosed for forming beam shapes with numerous unique qualities.

Specific examples are primarily given for a phased array disclosed and claimed in U.S. patent application Ser. No. 11/421,504, entitled "Millimeter Wave Electronically Scanned Antenna", filed Jun. 1, 2006, in the name of: Cole A. Chandler ("the '504 application"). This design uses 1-bit phase shifters that are either in (0° shift) or out (180° shift) of phase. The 1-bit phase shifter provides a binary environment where operators such as AND, OR, XOR provide powerful abilities to beam steering and allow beam patterns to be combined or "augmented." The construction and operation of this apparatus are discussed in further detail below at the conclusion of the present discussion. Note, however, that alternative embodiments may employ alternative apparatus. Those ordinarily skilled in the art shall be able to readily extend the present discussion to such alternative embodiments given the benefit of this disclosure.

The present discussion is organized into five sections. The first section describes how phased arrays are steered, with an emphasis on how to steer an array of the form disclosed in the '504 application. This includes a brief discussion of the array architecture and defines a beam steering pattern. The next section introduces a new concept called steering augmentation, which creates a method of combining steering patterns. A large set of operators that provide unique beam forming characteristics are given. The third section introduces the concept of combining beams. This concept allows multiple lobes of similar magnitude to be cast in several directions and the same time. It further allows multiple beams to be cast in almost identical directions to produce a spoiled, or wider, beam. The fourth section offers a potential method for adaptive beam gain control, where the gain of the beam can be lowered as range decreases to prevent damage to the electronics. Finally, a method of casting nulls in desired directions is investigated. Again, specific examples will be focused on the 1-bit phase shifter array disclosed in the '504 application.

Electronically steered antennas and phased arrays form and steer electromagnetic beams used to track objects relative to the antenna. As the relative position of the object changes with respect to the antenna, the phases of the electromagnetic signals emanating from the individual array elements on the array are adjusted so that constructive interference is created in the direction of the object. The constructive interference forms the main lobe of the antenna beam. Side lobes are also formed in other directions. There is also deconstructive interference that creates nulls, or directions where little or no energy is broadcast. Energy is transmitted and received primarily in the direction of the main lobe. However, the side lobes contribute a non-negligible amount of energy for both transmission and reception, and therefore need to be taken into account when attempting to steer the main lobe.

As illustrated in FIG. 3, the basic principle of forming a beam in a given direction is to have the signals 300 (only one indicated) emanating from each radiating element, collectively represented by the segmented line 303, be exactly in phase when the signals 300 pass through a plane 306 that is normal to the direction 309 that the beam is to be steered. FIG. 4 shows the orientation of the coordinate system 400 looking forward through the array 403 being used to describe the beam steering algorithm. The horizontal axis is the Y-axis. The vertical axis is the Z-axis. The X-axis points into the page. An element's y and z position will be referenced to the geometric center 406 of the array 403.

The '504 application discloses an apparatus, discussed further below, that does not use traditional ½ wavelength spacing. It uses element spacing of about 0.1 wavelengths and each element has a 1-bit phase shifter that either does nothing to the signal or shifts it by 180°. The array also has a feed structure in which the electromagnetic waves travel from a reference point to each element through a dielectric medium. The physical feed-lengths between elements is 0.1 of the free-space wavelength; however the electromagnetic waves do not oscillate through just 0.1 of a full cycle. Since the wave is moving through a dielectric medium, the electromagnetic wave travels more slowly, while the frequency remains the same, resulting in a shorter wavelength while traveling through the medium.

Unlike a typical ½ wavelength phased array (where if all of the elements are in phase, then the beam forms along the boresight), if no phase shifting is performed on the apparatus of the '504 application, then there is massive deconstructive interference, and no beam forms. This is because the electromagnetic wave that has traveled through the dielectric medium does not reach each element in phase. In fact, a phase shift of 54° will occur as you move from element to element away from the reference signal. To steer this array, one accounts for the phase shift due to the feed structure. In general terms, the algorithm for calculating the required phase shift for each element of the array is:

$$s_{i,j}=\text{floor}(\text{mod}((f_{i,j}n-y_{i,j}e_y-z_{i,j}e_x)p,1)2^k),$$

where $s_{i,j}$, the floor function, modulus function, $f_{i,j}$, n, $y_{i,j}$, $z_{i,j}$, $e_y$, $e_z$, p, and k are as defined above.

For the apparatus of the '504 application with a centrally fed feed structure, the central portion of the $f_{i,j}$ array is shown in FIG. 5A. The central portion of the $y_{i,j}$ array looks as is shown in FIG. 5B. The central portion of the $z_{i,j}$ array is shown in FIG. 5C. This particular embodiment includes a 6,480 element array that is 90×90 elements across and 0.1 wavelength spacing. The dielectric constant is assumed to be 1.5. The shape of the array is such that is fits into a circular space. However, the principles disclosed herein should be readily extrapolated to other suitable arrays by those of ordinary skill in the art.

Or consider a more specific example in which the phase shifter selection function is:

$$s_{i,j}=\text{floor}(2\ \text{mod}(p(y_{i,j}e_y+z_{i,j}e_z-f_{i,j}n),1)),$$

where $s_{i,j}$, p, $f_{i,j}$, n, $y_{i,j}$, $z_{i,j}$, $\bar{e}_s$, mod(a,b), and floor(a) are defined as above.

Figures 6D, 6E:
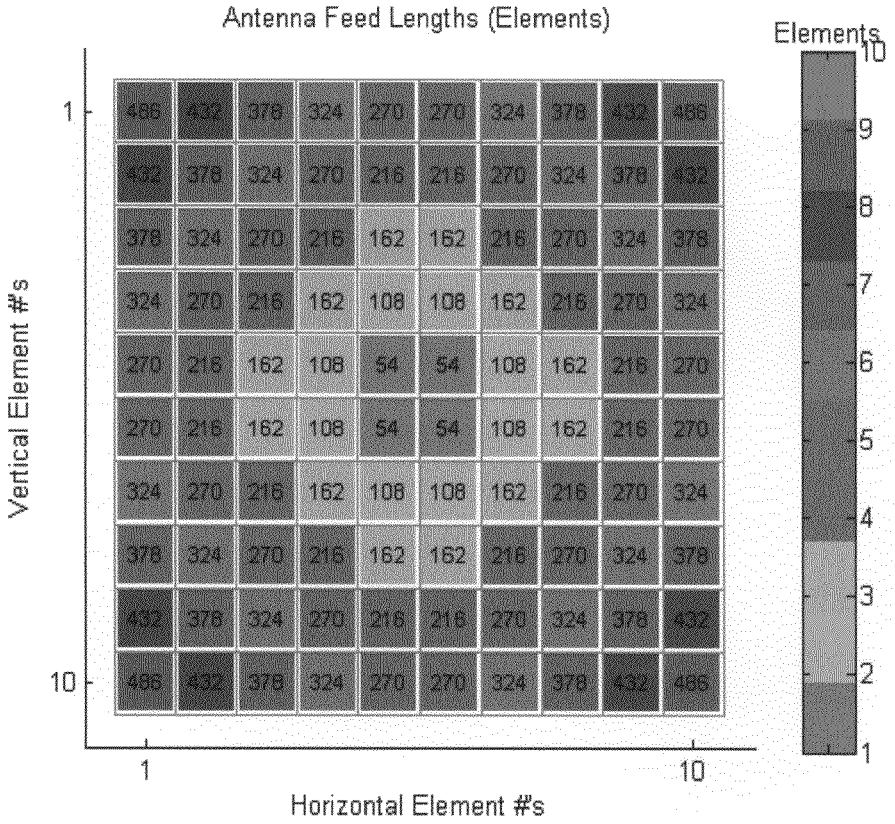

In this particular embodiment, p=0.1 and n=1.5. Again, the central portion of the $f_{i,j}$ array is shown in FIG. 5A, the central portion of the $y_{i,j}$ array looks is shown in FIG. 5B and the central portion of the $z_{i,j}$ array is shown in FIG. 5C. The steering function $s_{i,j}$ is shown in binary in FIG. 6A and in greyscale in FIG. 6B. FIG. 6C illustrates the radiated beam pattern steered by the shift pattern of the array of FIG. 6A-FIG. 6B. FIG. 6D illustrates by array element position phase angles (°) behind the reference numerically and the feed lengths by number of elements in greyscale. For additional clarity, FIG. 6E again shows the transmitting phase angle behind the reference signal at each element after traveling along the feed paths and, after each phase shifter has applied its commanded shift (i.e., 0° or 180°). Angles have been "wrapped", so that all angles are between 0° and 360°. Similarly, element phase shifter commands in degrees are shown numerically in FIG. 6F.

FIG. 7 shows the steering beam pattern for a beam along 0° azimuth and 0° elevation. The diamond pattern is due to the feed structure's phase-shifts at each element. FIG. 8 shows the beam pattern associated with FIG. 7. Steering the beam to other orientations will cause the diamond pattern to warp as shown in FIG. 9, which shows a 15° azimuth and 0° elevation beam steering command. Steering in both azimuth and elevation, as in FIG. 10, warps the diamond pattern even further.

Figure 11A:
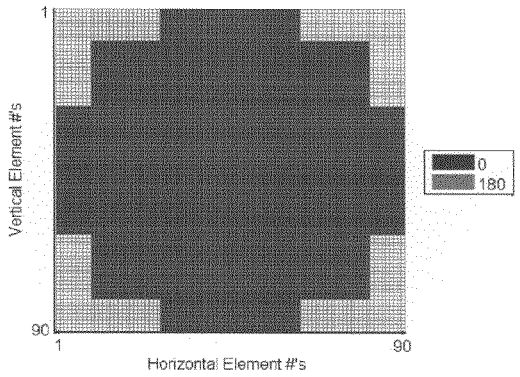
FIG. 11A-FIG. 11L show numerous other useful beam steering patterns that can be used to augment a nominal beam pattern.
Figure 11B:
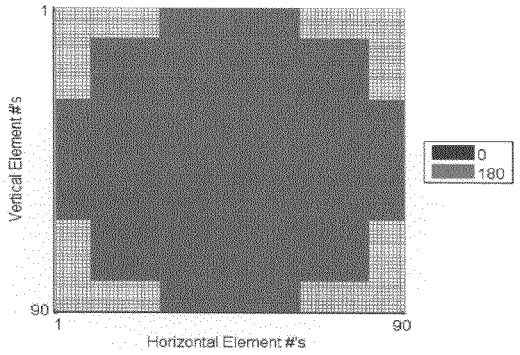
Figure 11C:
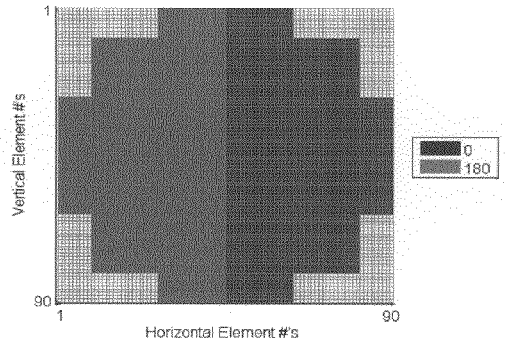
Figure 11D:
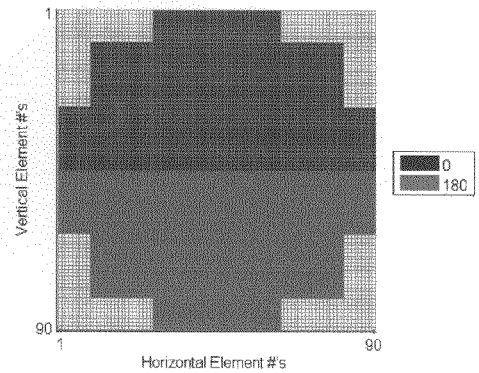
Figure 11E:
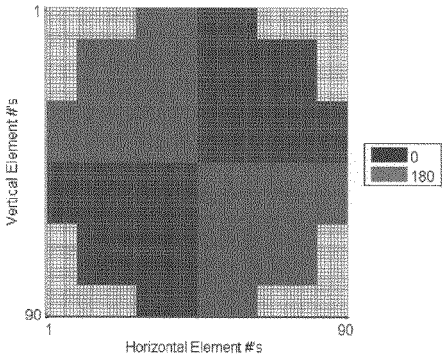
Figure 11F:
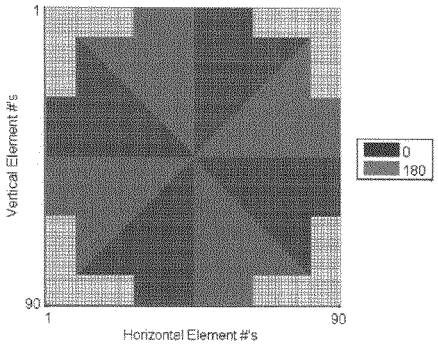
Figure 11G:
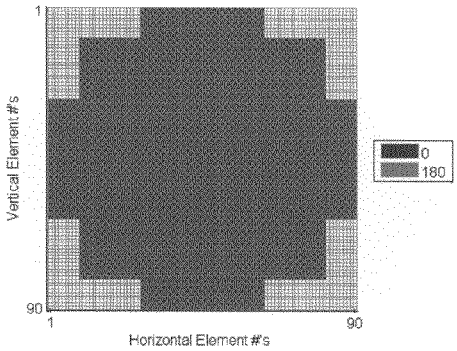
Figure 11H:
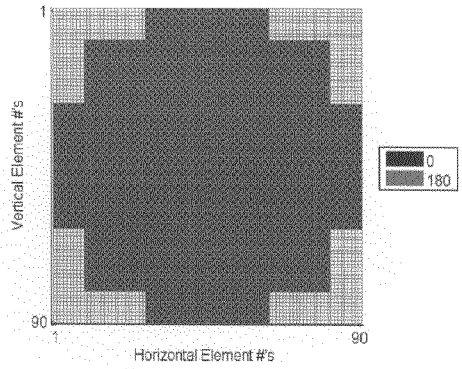
Figure 11I:
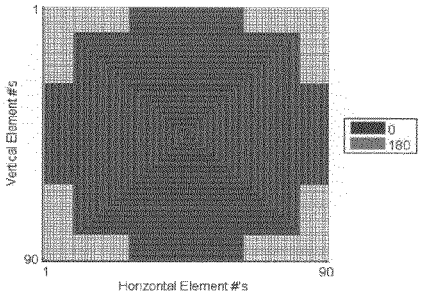
Figure 11J:
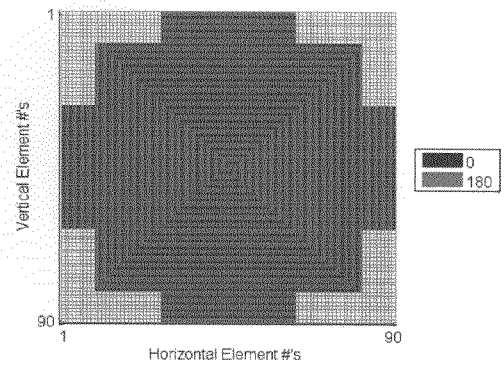
Figure 11K:
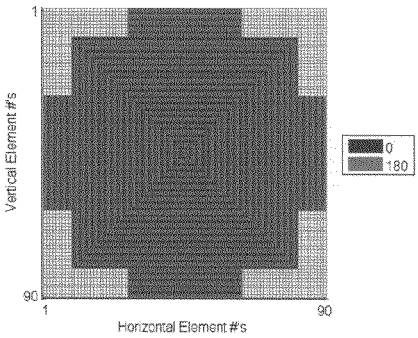
Figure 11L:
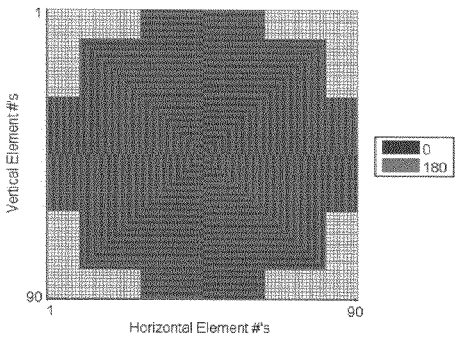

A unique set of mathematics, or "steering operators", can be constructed using 1-bit phase-shifter beam steering patterns. Because the beam pattern is really a binary array, basic binary logic operators can easily be used. The binary operations AND, OR, and XOR provide useful effects on beam patterns. FIG. 11A-FIG. 11L show numerous other useful beam steering patterns that can be used to augment a nominal beam pattern. Each pattern has some form of symmetry. Most have the same number of in-phase as out-of-phase elements. More particularly:

- the "unity" pattern of FIG. 11A, when augmented to a beam pattern using an OR produces the identical beam steering pattern; i.e., FIG. 11A depicts a beam steering pattern for augmentation type #1 (unity);
- the "phase reverser" pattern of FIG. 11B, when augmented to a beam pattern using an AND produces the identical beam steering pattern—when used with an OR, it destroys the beam pattern; i.e., FIG. 11B depicts a beam steering pattern for augmentation type #2 (phase reverser);
- FIG. 11C shows the azimuth difference generating pattern; if the type #3 augmentation is combined with a beam steering pattern with an XOR, the azimuth difference beam pattern is generated; i.e., FIG. 11C depicts a beam steering pattern for augmentation type #3 (azimuth difference)
- FIG. 11D shows the elevation difference generating pattern. If the type #4 augmentation is combined with a beam steering pattern with an XOR, the elevation difference beam pattern is generated; i.e., FIG. 11D depicts a beam steering pattern for augmentation type #4 (elevation difference);
- FIG. 11E depicts a beam steering pattern for augmentation type #5 (quadrants);
- FIG. 11F depicts a beam steering pattern for augmentation type #6 (octants);
- FIG. 11G depicts a beam steering pattern for augmentation type #7 (odd/even);
- FIG. 11H depicts a beam steering pattern for augmentation type #8 (concentric diamonds);
- FIG. 11I depicts a beam steering pattern for augmentation type #9 (clockwise spiral);
- FIG. 11J depicts a beam steering pattern for augmentation type #10 (counter-clockwise spiral);
- FIG. 11K depicts a beam steering pattern for augmentation type #11 (concentric squares); and
- FIG. 11L depicts a beam steering pattern for augmentation type #12 (offset concentric squares).

Figure 12:
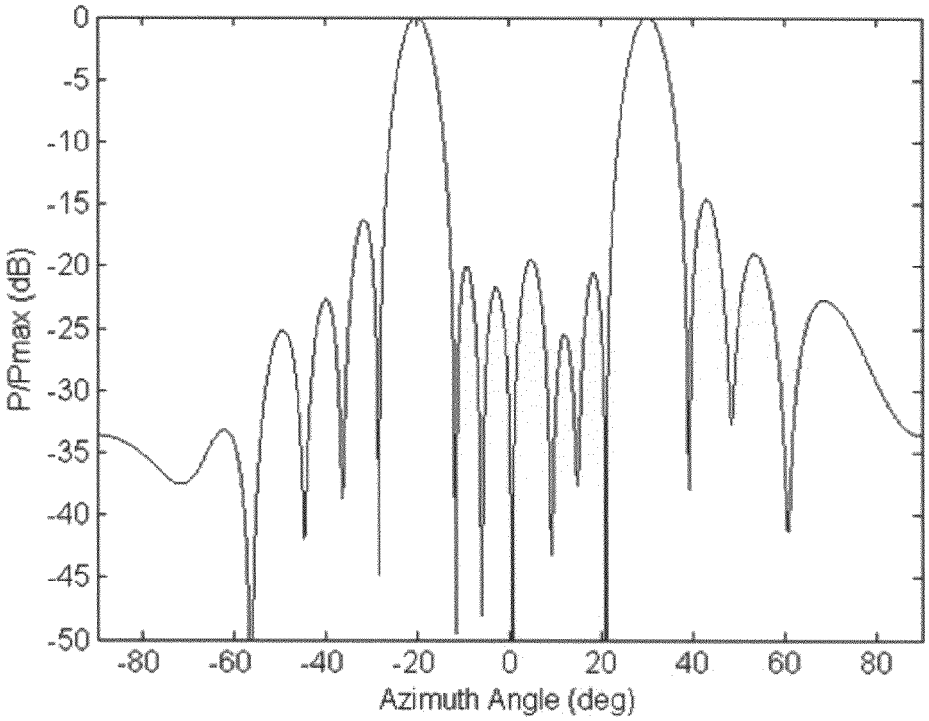
FIG. 12 graphs two separate beams at −20° and 30° azimuth in a combined beam pattern.

Turning now to beam combining, two beam patterns can be merged together using the AND operator. The resulting beam pattern produces two main lobes with approximately the same gain. FIG. 12 shows a resulting sum beam pattern for two beams: one at −20° and one at 30°. Each main lobe has a power 6 dB lower than the power for a single beam.

Figure 13A:
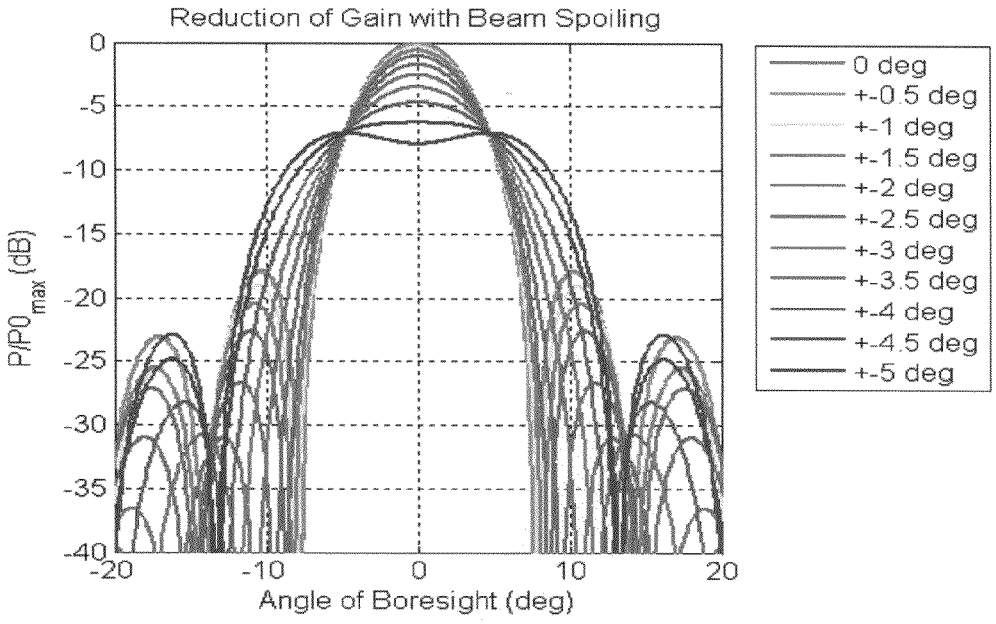
FIG. 13A-FIG. 13C show the effect of separating two beams by angles from 0° to 10° and centered about 0°.
Figure 13B:
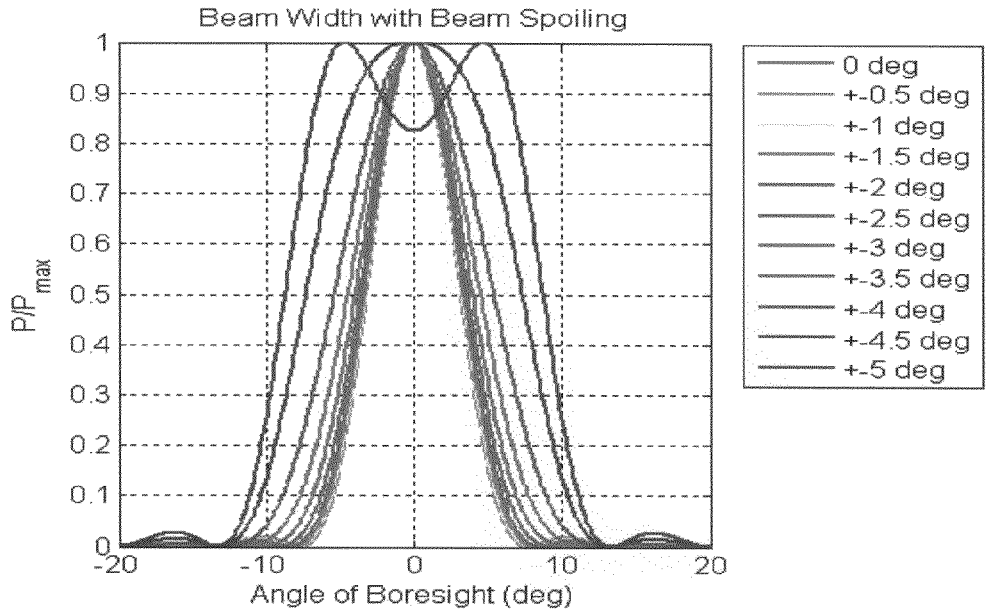
Figure 13C:
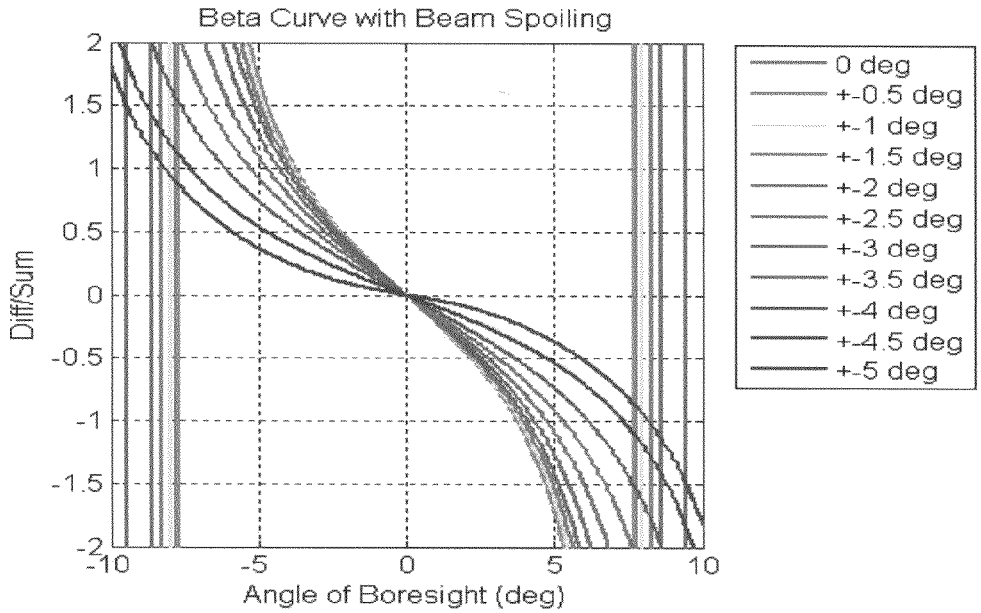

Combining two beam patterns that are pointing in the vicinity of each other can produce a wider beam, while spreading out the energy across the larger beam. This is known as "beam spoiling". Table 1 and FIG. 13A-FIG. 13C show the effect of separating two beams by angles from 0° to 10° and centered about 0°. The beam width can be increased at a cost of peak gain in the antenna pattern.

TABLE 1

Effect of Beam Spoiling on Beamwidth and Gain

| Spoiler Angle | Half Beam Width | Beam Width | Pmax | Change in Peak Gain |
|---|---|---|---|---|
| 0.0 | 3.2314 | 6.4627 | 0.40833 | 0.0 |
| 0.5 | 3.2323 | 6.4647 | 0.39774 | −0.11409 |
| 1.0 | 3.2971 | 6.5941 | 0.37779 | −0.33762 |
| 1.5 | 3.3788 | 6.7576 | 0.35034 | −0.66521 |
| 2.0 | 3.4737 | 6.9473 | 0.31621 | −1.1103 |
| 2.5 | 3.6613 | 7.3226 | 0.27039 | −1.7902 |
| 3.0 | 3.9713 | 7.9427 | 0.22465 | −2.5951 |
| 3.5 | 4.4767 | 8.9534 | 0.17889 | −3.5843 |
| 4.0 | 5.3954 | 10.791 | 0.13693 | −4.7451 |
| 4.5 | 7.3161 | 14.632 | 0.095585 | −6.3062 |
| 5.0 | 8.716 | 17.432 | 0.079029 | −7.1323 |

Figure 14A:
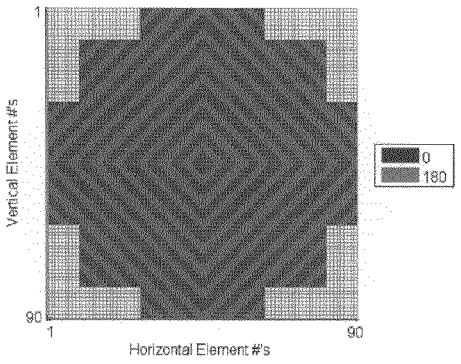
FIG. 14A-FIG. 14F illustrate gain control through use of various augmentation patterns.
Figure 14B:
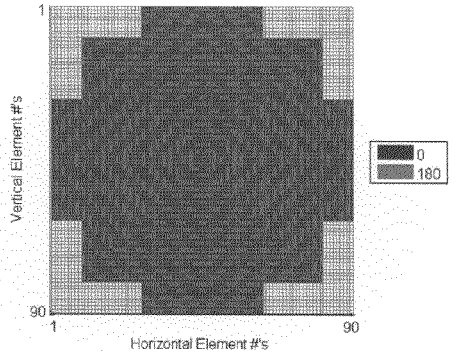
Figure 14C:
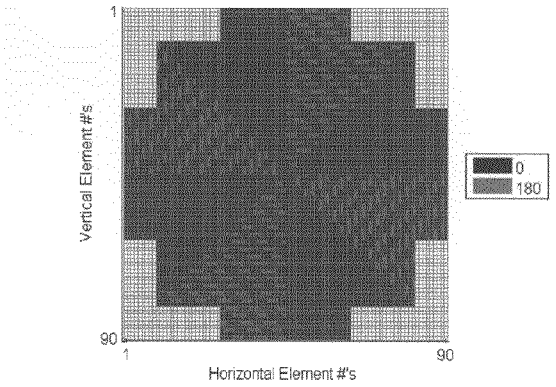
Figure 14D:
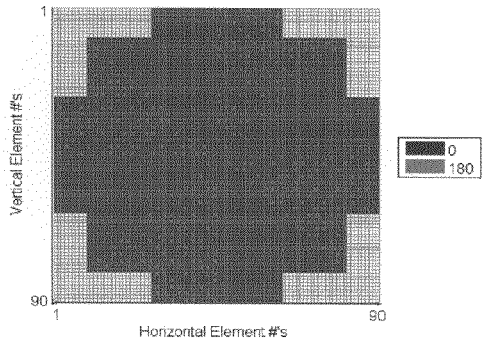
Figure 14E:
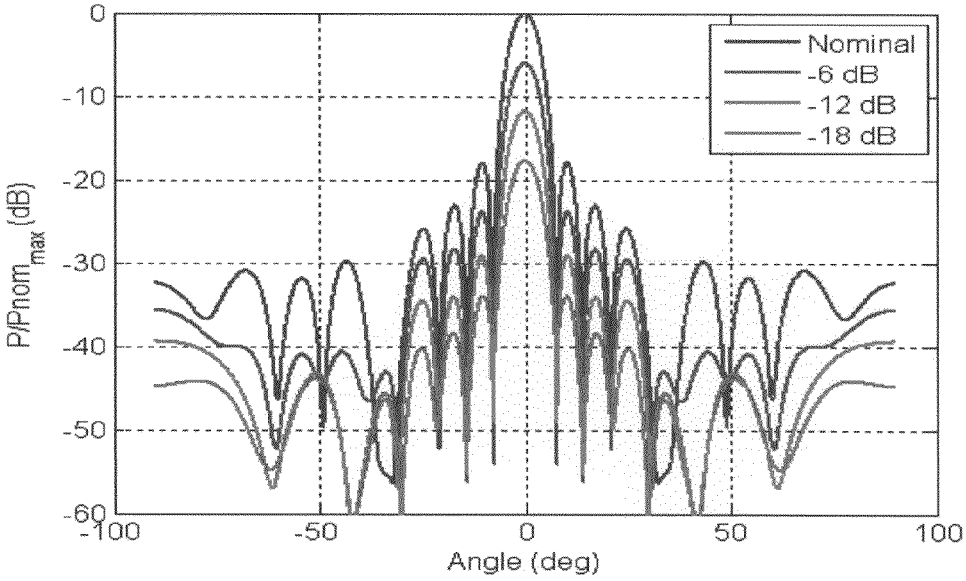
Figure 14F:
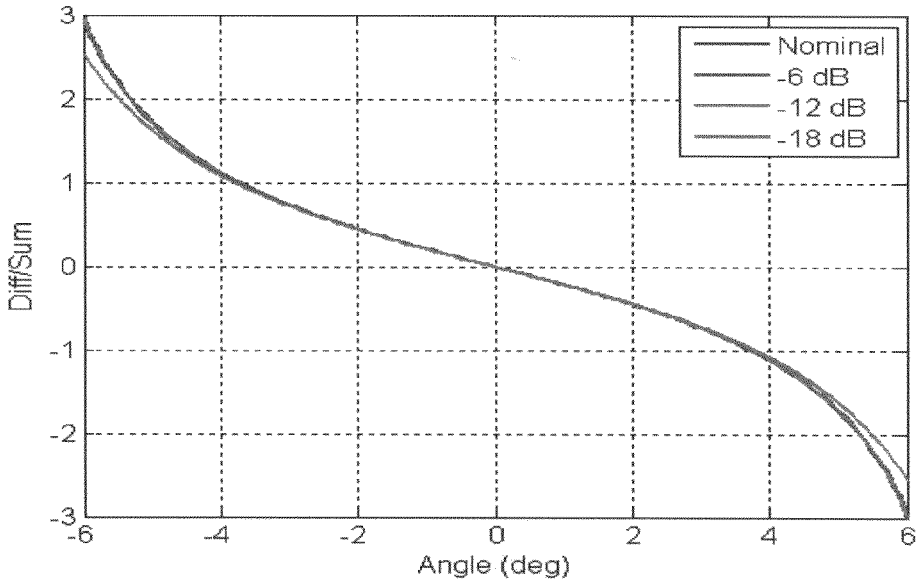

Turning now to gain control, by applying various beam pattern augmentation patterns to the nominal beam steering pattern, different beam gain levels can be achieved while maintaining the same beam width. Consider the beam steering pattern shown in FIG. 14A. If an element by element logical AND is performed between the nominal beam pattern and augmentation type #10, then the beam pattern shown in FIG. 14B results and produces a beam pattern with the same beam width as the nominal beam pattern as shown in FIG. 14E, but with a gain level 6 dB below the nominal. Applying another logical AND with augmentation type #12 produces the beam pattern in FIG. 14C with an additional drop in gain of 6 dB. Finally, FIG. 14D is the beam steering pattern produced by an additional AND with augmentation type #7 and generates a further 6 dB reduction in gain. This process generated a total of 18 dB reduction in gain in 6 dB increments. This method could be used for both transmit and receive patterns. The azimuth difference patterns for the resulting beam patterns are shown in FIG. 14F.

Figure 15A:
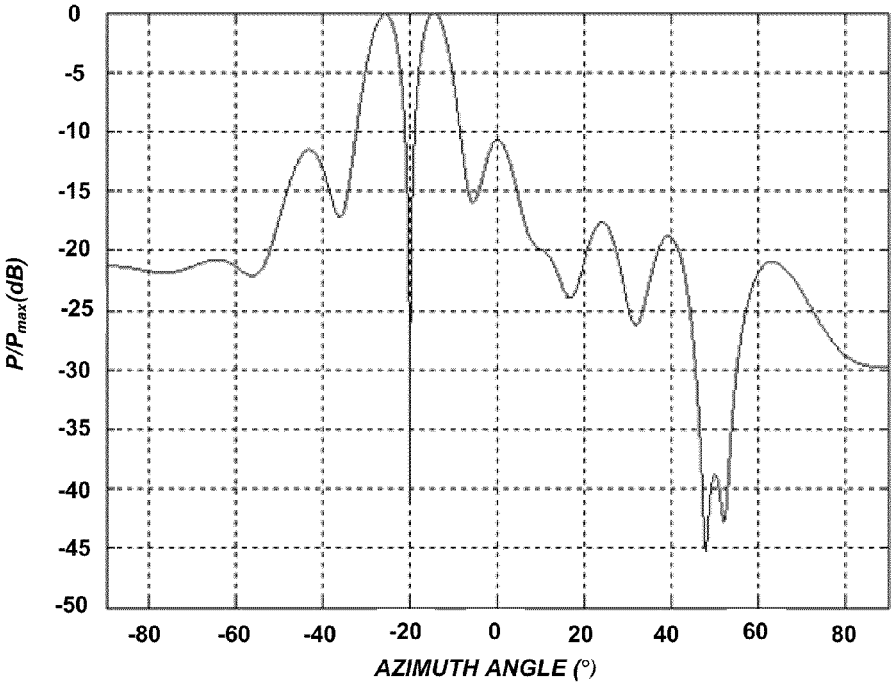
FIG. 15A-FIG. 15J illustrate the casting of nulls.
Figure 15B:
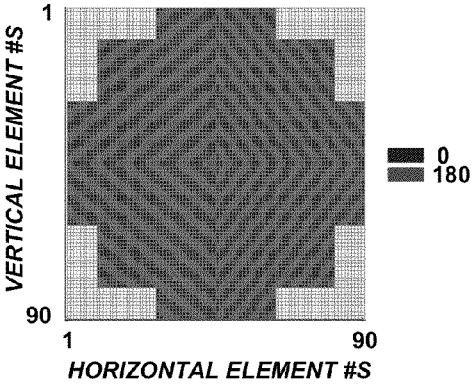
Figure 15C:
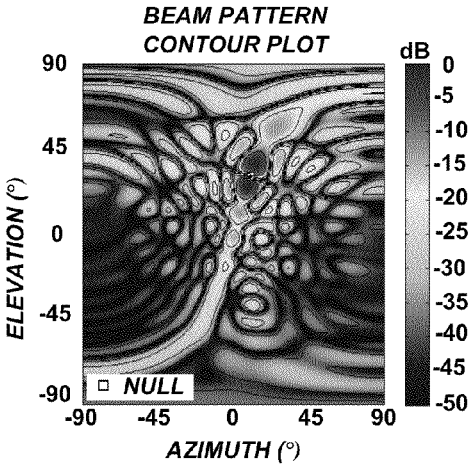
Figure 15D:
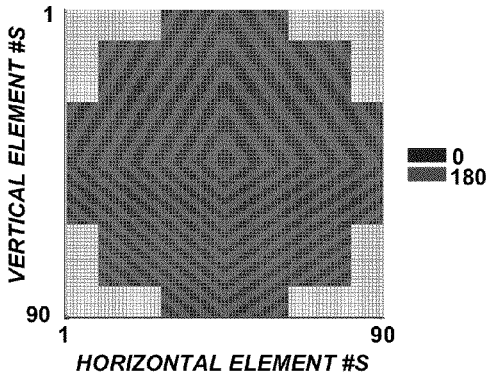
Figure 15E:
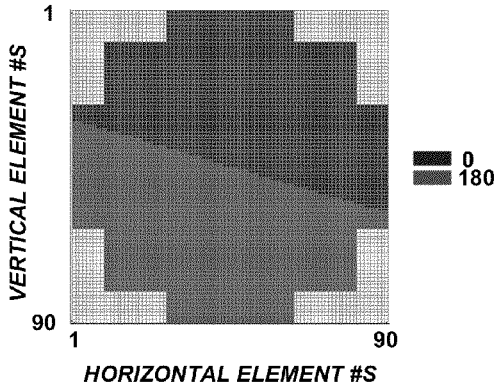
Figure 15F:
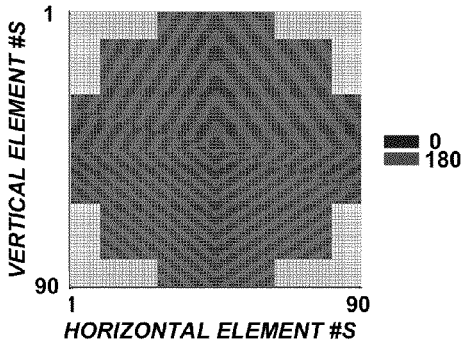
Figure 15G:
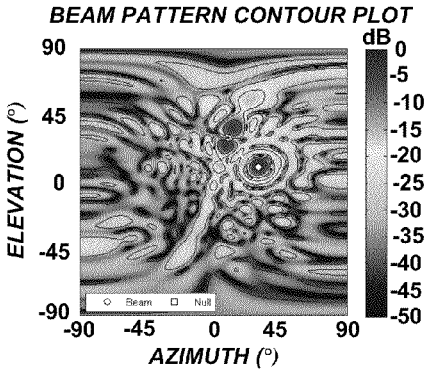
Figure 15H:
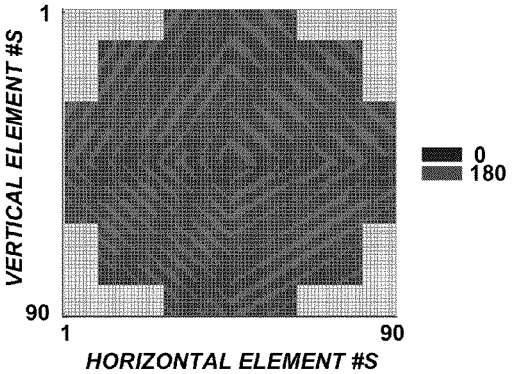
Figure 15I:
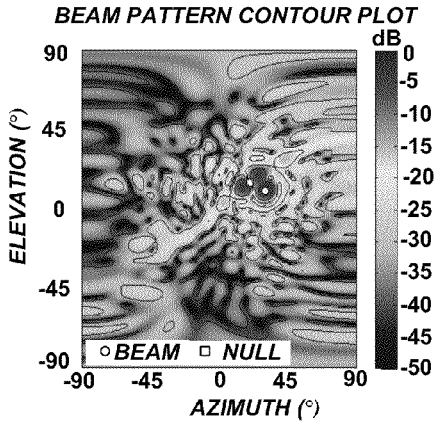
Figure 15J:
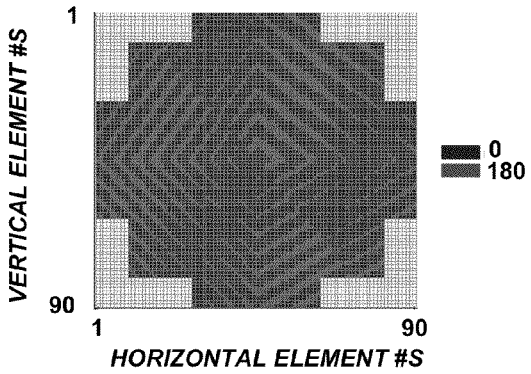

With respect to casting nulls, nulls in a desired direction can be constructed by augmenting a normal beam pattern. FIG. 15A shows the results of casting a null at −20° azimuth using the "azimuth difference" augmentation and the XOR operator. For cases where the null needs to be placed in both azimuth and elevation simultaneously, a rotated difference pattern can be used. FIG. 15B depicts the beam steering pattern that generated the null at −20°. FIG. 15C-FIG. 15F show how to place a null at 10° azimuth and 30° elevation. FIG. 15G and FIG. 15H show a case where a main beam is steered to 30° azimuth and 10° elevation while simultaneously steering a null to 10° azimuth and 30° elevation. FIG. 15I and FIG. 15J show a case where a main beam is steered to 30° azimuth and 10° elevation while simultaneously steering a null to 20° azimuth and 15° elevation. This may offer a "poor-man's" form of adaptive processing and could aid in countering electronic-countermeasures.

As was mentioned above, one suitable apparatus for practicing the method of the invention is disclosed and claimed in co-pending U.S. patent application Ser. No. 11/421,504, entitled "Millimeter Wave Electronically Scanned Antenna", filed Jun. 1, 2006, in the name of: Cole A. Chandler ("the '504 application"). The '504 application disclosed a technique for steering a beam using a one-bit phase shifter. However, the technique disclosed in the '504 application did not attempt to manipulate the beam to generate nulls at specified locations. To further an understanding of the present invention, selected portions of the '504 application will now be excerpted. Note, however, that the invention is not limited to the apparatus of the '504 application. Other embodiments may employ other antenna designs.

The apparatus of the '504 application is a dense microstrip antenna that uses a 1 bit phase shifter combined with a dense (~1/10) element spacing to achieve beam steering. The antenna uses a simple efficient traveling slow wave feed structure to deliver power to the dense microstrip antenna elements. The antenna is constructed of building blocks of microstrip boards called "slats" that are essentially self-contained linear arrays. The slats are then stacked to form the 2D planar array. Feed inputs to one-half of each slat enable a quadrant topology to support monopulse processing. The dense microstrip antenna utilizes wafer level microstrip transmission lines in conjunction with a one bit/state fixed phase shifter and a "grating" pattern to achieve beam steering. Two-dimensional beam steering is achieved by superimposing a periodic one bit phase shift on the appropriate traveling wave linear phase shift using microstrip transmission lines.

Figure 19C:
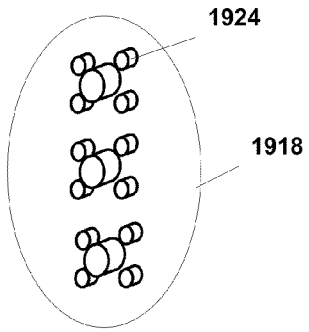
FIG. 19A-FIG. 19C illustrate an antenna constructed from a plurality of radiating antenna components such as the one illustrated in FIG. 16A-FIG. 18B.
Figure 16A:
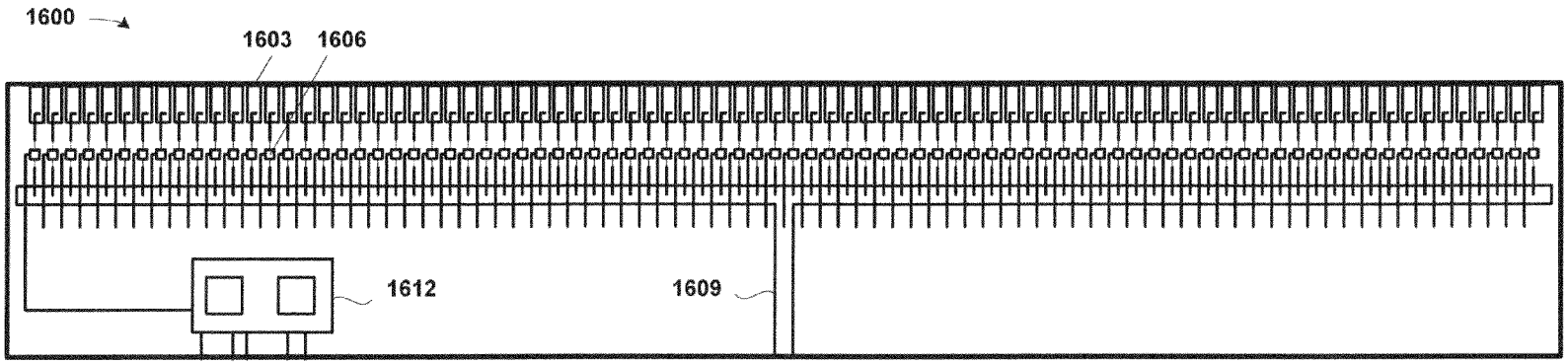
FIG. 16A-FIG. 16B illustrate a multi-layer radiating antenna component.
Figure 17B:
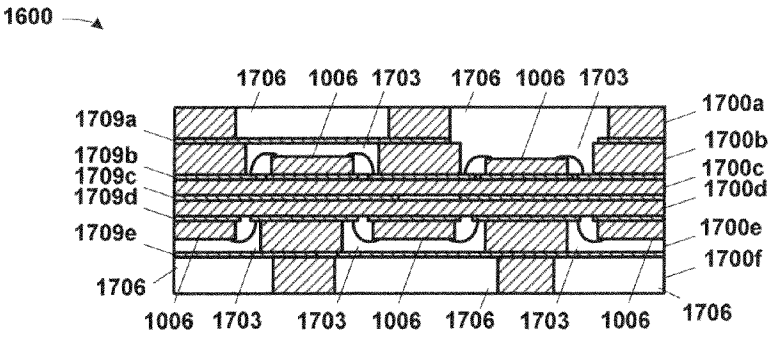
FIG. 17A-FIG. 17D illustrate the construction of the antenna component of FIG. 17A-FIG. 17B.
Figure 16B:
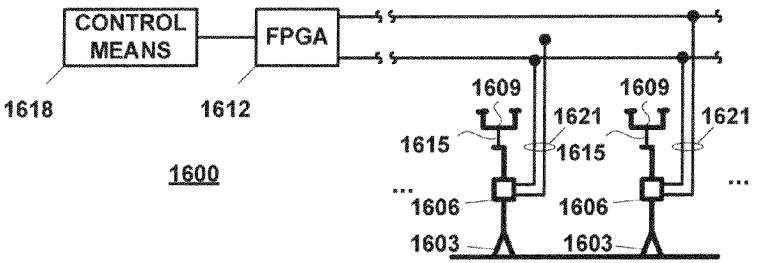
Figure 17A:
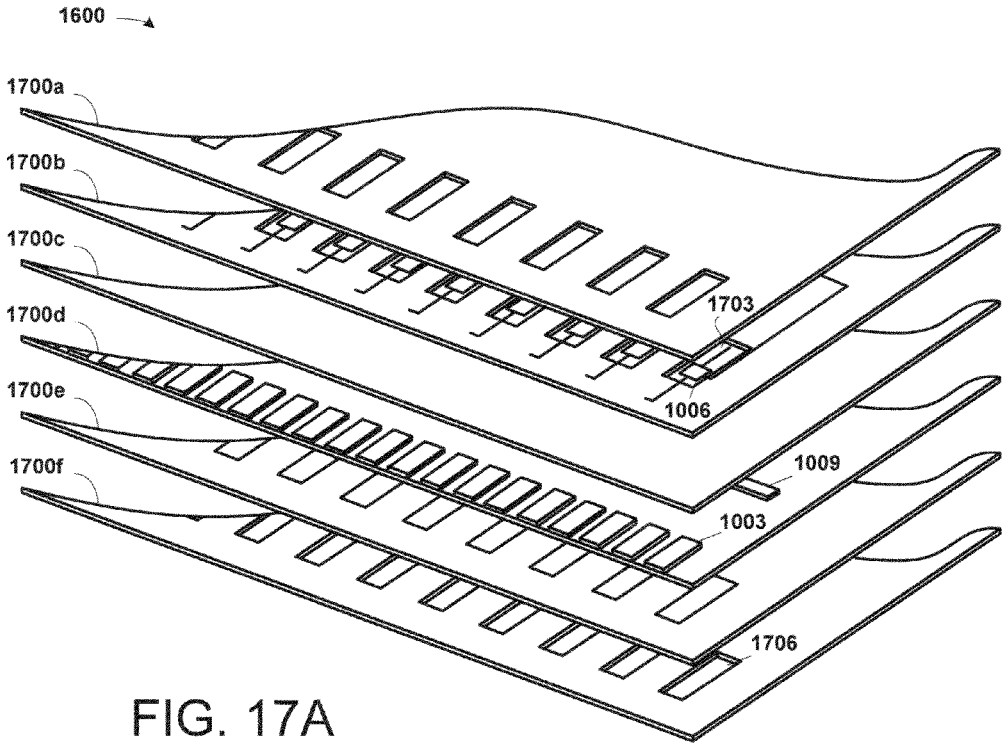
Figure 17C:
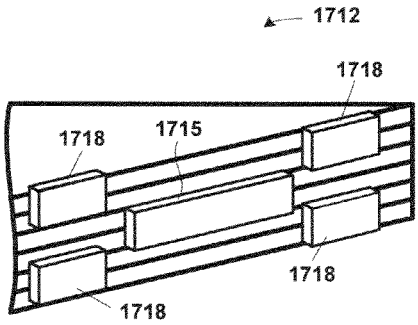
Figure 17D:
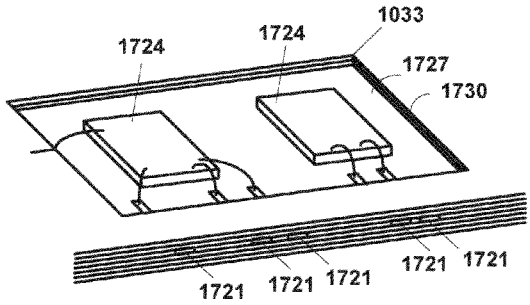
Figure 18A:
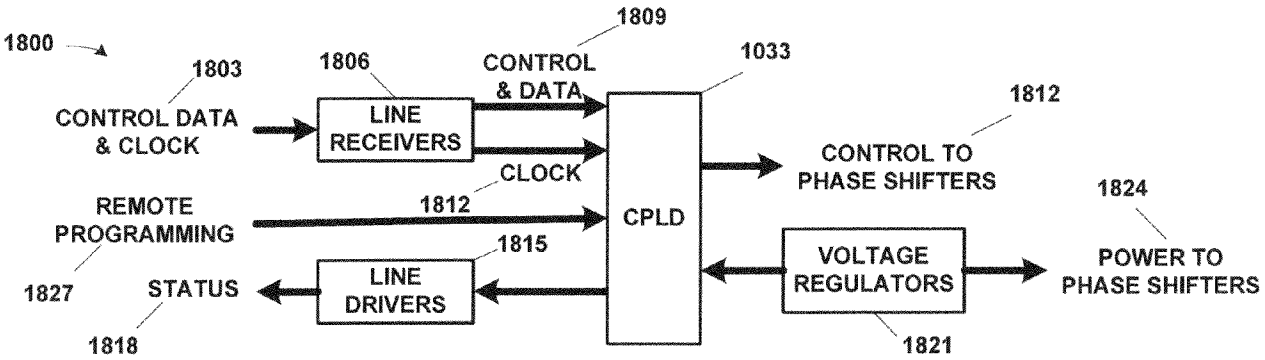
FIG. 18A-FIG. 18B illustrates functionality the control elements of the radiating antenna component, first shown in FIG. 17D, and of a coupling antenna component with which the radiating antenna component may be used, respectively.
Figure 18B:
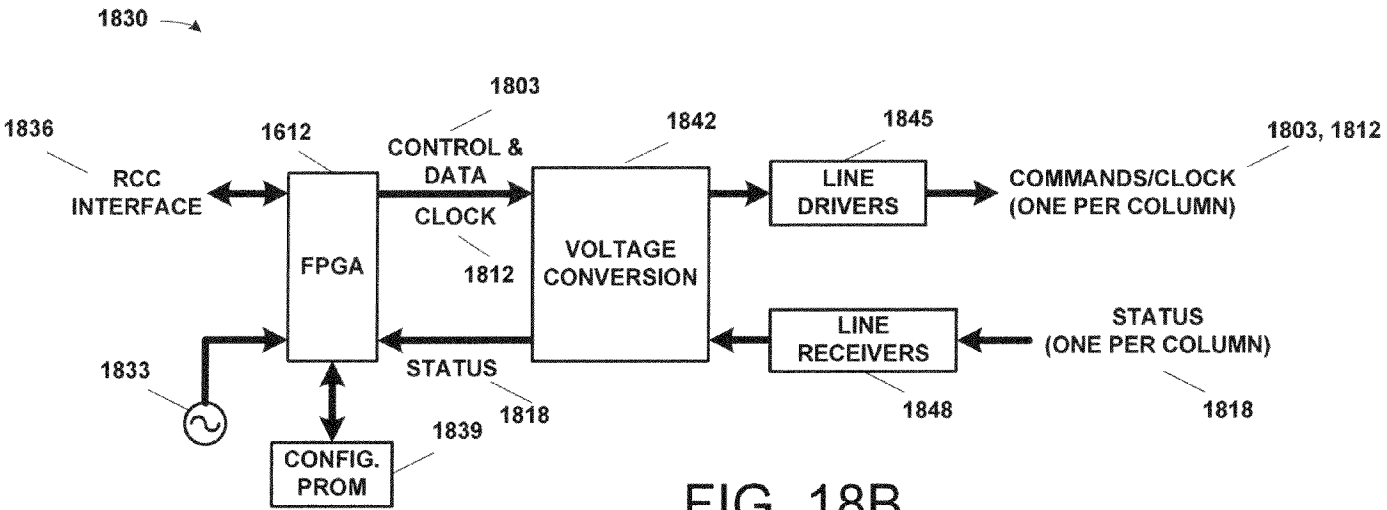
Figure 19A:
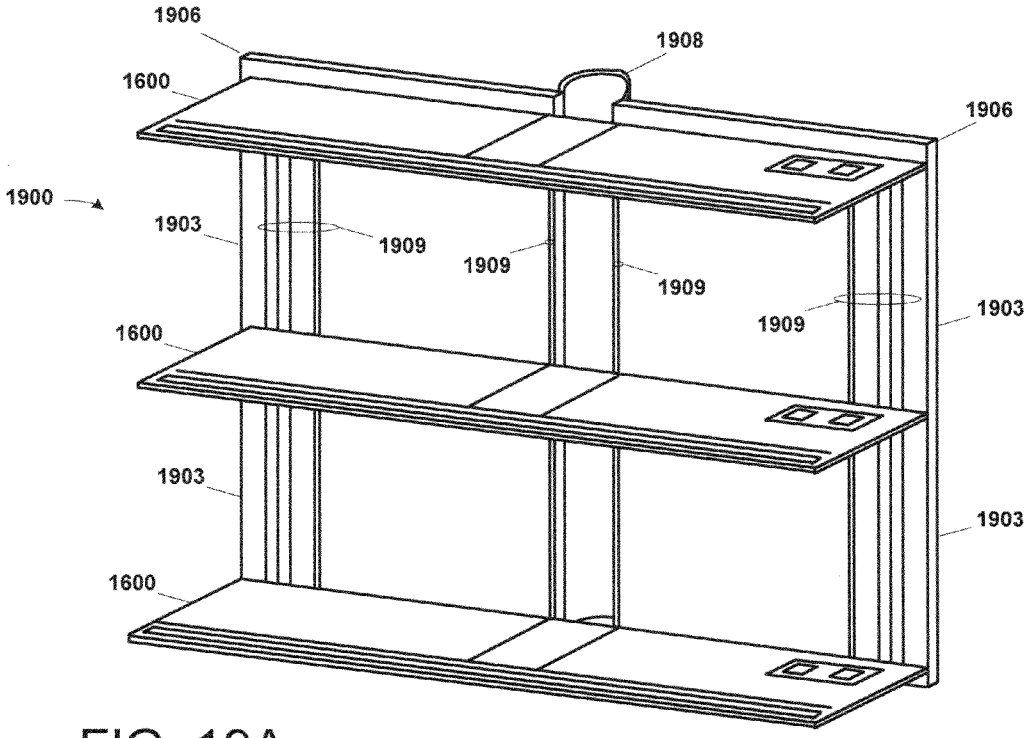
Figure 19B:
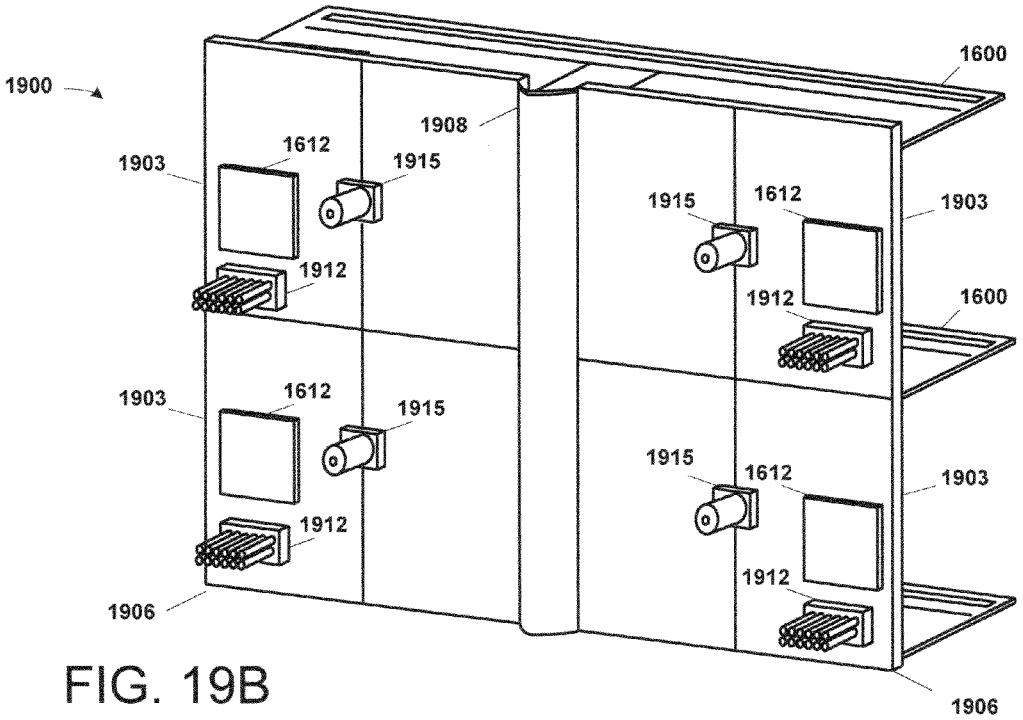

FIG. 16A-FIG. 18B illustrate one particular multi-layer radiating antenna component 1600. FIG. 16A depicts the functional inter-relationships of the various parts of the radiating antenna component 1600 and FIG. 16B illustrates a radiating element 1603 and its relationship to the traveling wave line 1609 of the antenna component 1600. FIG. 17A-FIG. 17D illustrate various aspects of the construction of the antenna component 1600, shown in FIG. 16A. FIG. 18A-FIG. 18B illustrates functionality the control elements of the radiating antenna component 1600, first shown in FIG. 17D, and of a coupling antenna component with which the radiating antenna component 1600 may be used. FIG. 19A-FIG. 19B illustrate an antenna 1900 constructed from a plurality of radiating antenna components 1600.

Referring now to FIG. 16A, like the embodiments previously discussed, the radiating antenna component comprises a plurality of radiating elements 1603 (only one indicated), a plurality of one-bit fixed phase shifter 1606 (only one indicated), and a traveling wave phase shift line 1609 that interact and function as described above. Note that the traveling wave phase shift lines in previous embodiments (e.g., the traveling wave phase shift lines 1609 in FIG. 16A) are meander lines. However, other microstrip slow wave structures are possible with the selection of the circuit dimensions and material properties. For instance, the traveling wave phase shift line 1609 is a straight microstrip line that achieves the same purpose. Thus, the traveling wave phase shift line 1609 is, by way of example and illustration, is a second means for feeding the radiating elements 1603 alternative to that previously shown.

As is better illustrated in FIG. 16B, the one-bit fixed phase shifters 1006 are electrically connected to the traveling wave phase shift lines 1609 by coupling structures 1615. The operation of the one-bit fixed phase shifters 1006 is controlled by a control means 1618 over the control lines 1621. More particularly, phase control is exerted on one of the control lines 1621 and status information is output by the one-bit fixed phase shifter 1006 on the other control line 1621. Note that the control lines 1621 include line drivers and receivers (not shown). The control means 1618 may comprise, for instance, a programmable processor (not shown) of some kind program storage medium (not shown) containing the control program for the programmable processor.

The control means 1618 thereby controls the one-bit fixed phase shifter 1006 to steer the grating to control the pattern of the radiated energy. That is, the control means 1618 selects the required phase grating pattern to steer the beam. Thus, the one-bit fixed phase shifter 1006 of the illustrated embodiment comprises, by way of example and illustration, a means for steering the radiated energy. In operation, the control means 1618 outputs a serial data stream to the traveling wave phase shift line 1609, the data stream containing the settings for each of the one-bit fixed phase shifters 1006 for each of the radiating antenna components 1600.

Each radiating antenna component 1600 includes a means for reformatting signals 1612 that, in the illustrated embodiment, de-multiplexes an input serial data stream into a parallel signal. Typically, the re-formatting means 1612 will be implemented as a logic device, but it could also be, for instance, a hard-wired electronic circuit. In the illustrated embodiment, the re-formatting means is a programmable logic device and, more particularly, a field programmable gate array ("FPGA"). The FPGA 1612 converts (in parallel) the data stream and generates a switch signal (including inversion, if required) for each one-bit fixed phase shifters 1006 of the respective component 1600.

The shape, dimensions, etc. of the traveling wave phase shift line 1609 are determined by the desired traveling wave phase shift for the antenna being implemented. Note that the traveling wave phase shift line 1609 can be implemented using a meander line or a slow wave structure in alternative embodiments.

The aperture element distribution ("$AE_m$"), i.e., the distribution of the radiating elements 1603, can be determined by Eq. (1):

$$AE_m = (AW_m)^{1/2}\exp\left[\frac{i2\Pi x_m}{\lambda/n} + i\Pi G_m\right] \quad \text{Eq. (1)}$$

where:

m≡the element number $AW_m$≡the amplitude weighting, shown in FIG. C2 for the illustrated embodiment, which will be a function of the antenna design (e.g., side lobe level requirement) and tends to suppress side lobes;

$x_m$≡the physical distance between each radiating element 1603, which is constant, or uniform, in the illustrated embodiment;

λ≡the free space wavelength;

n≡the propagation constant (nominally 1.5 for the illustrated embodiment, but can be tailored by the design goals); and $G_m$≡the bi-phase steering modulation function.

Note that, in Eq. (1), the factor Π/(λ/n) is the traveling wave phase shift function and the factor $i\Pi G_m$ represents the grating pattern phase modulation. The steering modulation (a/k/a grating) period ("Λ") is represented by Eq. (2):

$$\Lambda = \frac{\lambda}{n - \sin\varphi} \quad \text{Eq. (2)}$$

where:

λ≡the free space wavelength;

n≡the propagation constant (nominally 1.5 for the illustrated embodiment, but can be tailored by the design goals); and ϕ≡the scanning angle.

The modulation sinusoid ("$g_m$") is represented by Eq. (3):

$$g_m = \sin\left[\frac{2\Pi x_m}{\Lambda}\right] \quad \text{Eq. (3)}$$

where:

m≡the element number;

$x_m$≡the element spacing, as defined above; and

Λ≡the steering modulation period, as defined above.

Thus, the grating function ("$G_m$") can be represented as:

$$G_m = \text{if}(g_m > 0, 1, 0) \quad \text{Eq. (4)}$$

where:

m≡the element number; and $g_m$≡modulation sinusoid, as defined above.

Consequently, $G_m$=1 if $g_m$>0 and $G_m$=0 otherwise. The grating function is therefore an on/off toggle. These are general solutions for phase grating modulation. Phase grating is known to the art and any suitable technique may be used.

The structure of the radiating antenna component 100 is a six-layered structure whose design is shown best in FIG. 17A. FIG. 17A is an exploded, perspective view of a portion of the radiating antenna component 1600 illustrating the six layers 1700*a*-1700*f* thereof. FIG. 17B is a cross-section of a portion of the radiating antenna component 1600.

FIG. 17A is an exploded, perspective view of a portion of the radiating antenna component illustrating the six layers thereof.

FIG. 17B is a cross-section of a portion of the radiating antenna component.

FIG. 17C illustrates edge connectors for radio frequency ("RF") signals input to the radiating antenna component.

FIG. 17D illustrates the control elements of the radiating antenna component.

The one-bit fixed phase shifters 1606 are micro-machined integrated circuits ("MMICs") and are epoxied or soldered to the layers 1700*b*, 1700*e* in blind cavities 1703 milled therein. However, the corresponding cavities 1706 in the layers 1700*a*, 1700*f* are through cavities, as opposed to blind cavities. Note, also, that the one-bit fixed phase shifters 1606 are alternated on the layers 1700*b*, 1700*e*. The one-bit fixed phase shifters 1606 are capacitively coupled to the radiating elements 1603 and the traveling wave phase shift line 1609 through the respective layers 1700*c*, 1700*d*.

Referring to FIG. 17A, the structure of the radiating antenna component 1600 also includes a plurality of signal lines 1709*a*-1709*e*. The signal lines 1709*a*, 1709*e* are stripline ground planes. The signal lines 1709*b*, 1709*d* include phase control, broadside radio frequency ("RF") couplers, and element feed lines, discussed further below. The signal line 1709*c* includes the radiating elements 1603 and the traveling wave phase shift line 1609, also shown in FIG. 16A, FIG. 17B.

Returning to FIG. 16A, details regarding the multi-layer construction of the radiating antenna component 1600 shown in FIG. 17A-FIG. 17B have been omitted from the conceptualization to more clearly illustrate the functional relationships. Thus, the radiating elements 1603 and the traveling wave phase shift line 1609 shown in FIG. 16A are actually fabricated between the layers 1700*c*, 1700*d*, as also shown in FIG. 17A-FIG. 17B. Similarly, the one-bit fixed phase shifters 1606 are actually affixed in the blind cavities 1703 in the layers 1700*b*, 1700*d*, also as shown in FIGS. 17A-FIG. 17B.

As was mentioned above, the signal lines 1709*b*, 1709*d*, shown in FIG. 17A, includes phase control and broadside RF couplers. These elements are shown more clearly in FIG. 17C-FIG. 17D. In particular, the RF connection is made through a pseudo-coax arrangement 1712 shown in FIG. 17C comprising a RF feed 1715 and multiple stripline ground planed connections 1718.

The control function is performed by a complex programmable logic device ("CPLD") 1612 shown in FIG. 17C. The CPLD 1612 receives the control signals from a controlling means, e.g., the control means 1618 shown in FIG. 16B, via a plurality of edge connectors 1721 shown in FIG. 17D. In this particular embodiment, the CPLD 1612 receives through the edge connectors 1721 a +3.3V, Clk+, Clk−, serial data stream (phase control) signals and transmits a status signal. Note that the devices 1724 of the CPLD 1612 are positioned in a blind cavity 1727 of a layer with a through cavity 1730 in the layer above.

The control system 1800 for the radiating antenna component 1600 is illustrated in FIG. 18A. The CPLD 1612 receives control, data, and clock signal(s) 1803 through a plurality of line receivers 1806, which separates the control, data, and a clock signals 1803 into separate control and data signals 1809 and a clock signal 1812. The CPLD 1612, in response, outputs control signals 1812 to the one-bit fixed phase shifter 1606. The control signals 1812 may include, for example, phase data, phase load strobe, and control voltage information. The CPLD 1612 also outputs via a plurality of line drivers 1815 one or more status signals 1818. The status signals 1818 may include, for example, voltages and valid stimulation indicators.

The control system 1800 also include a plurality of voltage regulators 1821 that provide power 1824 to the CPLD 1612 and to the one-bit fixed phase shifter 1606. The CPLD 1612 may also be remotely programmed by one or more remote program signal(s) 1827 should there be a desire to change the grating pattern. The control, data, and a clock signal 1803, status signal(s) 1818, and remote programming signal 1827 are input and output over the edge connectors 1721 shown in FIG. 17D. Note that the functionality of the control system 1800 can be removed from radiating antenna component 1600 in other embodiments. In these embodiments, the control system 1800 can be relocated to, for instance a coupling antenna component (not shown) associated with the radiating antenna component 1600. The control system 1800 might also be removed to some other part of the antenna (not shown) into which the radiating antenna component is assembled.

The control system 1830 for a coupling antenna component (not shown) in this embodiment is shown in FIG. 18A. An FPGA 1612 receives control data 1803 from a radar control computer ("RCC") interface 1836, e.g., the control means 1618 in FIG. 16B, and a clock signal from an oscillator 1833. Among the signals received from the RCC interface 1836 may be, for instance, timing signals (e.g., dwell start, re-steer, transmit/receive gate, and reset), stimulus signals, and command signals. The FPGA 1612 is programmed from a configurable programmable, read only memory ("PROM") 1839. The FPGA 1612 transmits the control data 1803 and the clock signal 1812 to the control system 1800, shown in FIG. 18A, in parallel via a voltage conversion 1842 and a plurality of line drivers 1845. The FPGA 1612 also receives the status information 1818 in parallel from the control system 1800 through a plurality of line receivers 1848 and the voltage conversion 1842 and passes it on to the RCC interface 1836. As with the control system 1800, the functionality of the control system 1830 can be removed from the coupling antenna component to, for example, some other part of the antenna (not shown) into which the coupling antenna component is assembled.

FIG. 19A-FIG. 19B illustrate an antenna 1900 constructed from a plurality of radiating antenna components 1600 (only three shown) and coupling antenna components 1903. The coupling antenna components 1903 form two four-quadrant backplanes 1906 with independent transmit/receive capabilities joined by a flexible ribbon connector 1908. Each backplane 1906 includes multiple signal distribution lines 1909 on one side, and DC control signal headers 1912, RF feeds 1915, and FPGAs 1612 on the other. FIG. 19C illustrates a portion 1918 of a signal distribution line 1909 through which ground and RF connections are made to the radiating antenna components 1600. This particular signal distribution line 1909 comprises a plurality of pseudo-coaxial connections 1921 that mate to the connections 1712, shown in FIG. 17C, of the individual antenna components 1600. The connections 1921 may comprise, for example, a plurality of spring-loaded detents 1924 (only one shown). Note, however, that other techniques may be employed. Note that the assembly cabinet for the antenna 1900 is not shown for the sake of clarity. Also, to obtain the desired vertical spacing between the radiating elements 1603, shims (not shown) may be employed between individual radiating antenna components.

Thus, in operation, an RCC generates a plurality of timing and control signals that are output to the control system 1830, shown in FIG. 18B. The control system 1830 distributes these signals as described above through the signal headers 1912, shown in FIG. 19B and the signal distribution lines 1909, shown in FIG. 19A. The RF signal is fed through the RF feeds 1915, shown in FIG. 19B, and the distribution lines 1909, shown in FIG. 19A. Referring now to FIG. 16A, the RF signal propagates to the radiating elements 1903 over the traveling wave phase shift line 1609. The CPLD 1612 of the control system 1800, shown more fully in FIG. 18A, relays the control signals as described above that control the operation of the one-bit fixed phase shifters 1606 to steer the radiating energy, also as described above.

Figure 20:
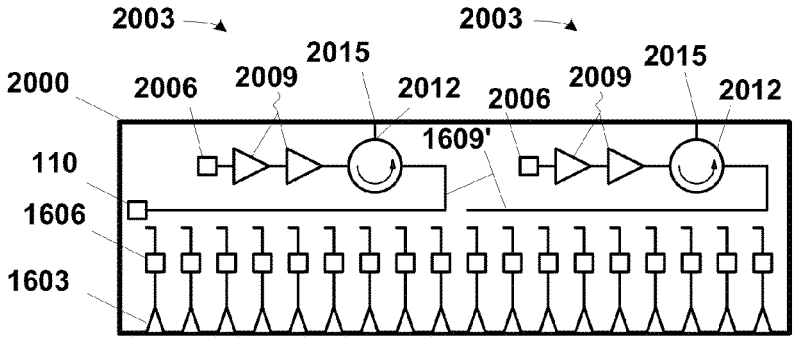
FIG. 20 is a conceptualization of the functional inter-relationships of the various parts of a radiating antenna component in an embodiment in which the antenna component is active and contains active components.

The approach implemented in the passive embodiments disclosed above can be modified to an "active" configuration that does not require conventional transmit/receive ("T/R") modules. The approach achieves a very high level of integration that reduces both cost and risk moving toward a wafer level integrated active antenna. The active antenna concept would use amplifiers at each quadrant input feeding the slat combined with a conventional receive configuration as shown in FIG. 20. The active dense microstrip approach provides many additional benefits and eliminates the need for a conventional T/R module.

More particularly, FIG. 20 illustrates an active antenna component 2000 that can be used in both transmit and receive modes. The active antenna component 2000 includes at least one active circuit 2003. In the illustrated embodiment, the antenna component 2000 is used in an quad configured antenna, and so the antenna component 2000 includes two circuits 2003, each one controlling a respective half of the antenna component 2000. The number of circuits 2003 will be implementation specific and is not material to the practice of the invention.

Each active circuit 2003 comprises a tuning circuit 2006, a pair of MMIC amplifiers 2009, and a circulator 2012. In the transmit mode, the antenna component 2000 receives the signal to transmit over the connection 2015 and directs it through the MMIC amplifiers 2009, which boost the signal, to the tuning circuit 2006. The tuning circuits 2006 for each antenna component 2003 operate to balance the gain and phase of the power amplifiers 2009. Note that some embodiments may be sufficiently robust that the tuning circuits 2006 may be omitted without loss of performance. Thus, the tuning circuits 2006 are optional from the standpoint of practicing the invention even though desirable in certain implementations.

The signals reflect back through the MMIC amplifiers 2009 to the circulator 2012 which then directs it along the traveling wave phase shift line 1609' whereupon it is transmitted from the antenna component 2000 through the one-bit fixed phase shifters 1006 and radiating elements 1603. In the receive mode, the antenna component performs as do the embodiments disclosed above, the received signal being output over the connection 2015 through the circulator 2012.

The redundant receivers required by a conventional T/R approach to overcome the phase shifters are eliminated due to the dense microstrip's improved efficiency. The removal of the receiver greatly improves the transmit amplifier design by allowing more gain, volume, and thermal management options. These features add up to provide a solution for an Active Electronically Scanned Array that is better suited for some low-cost, high performance applications, e.g., missiles.

Figure 21A:
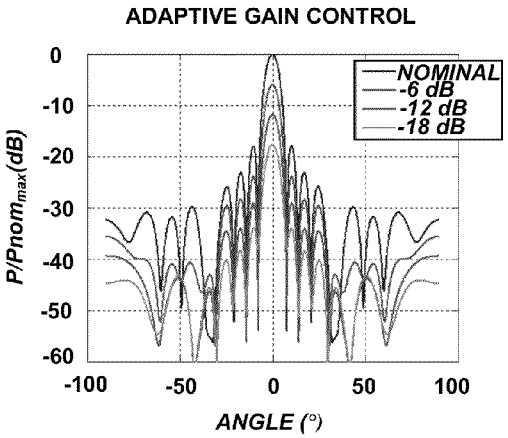
FIG. 21A-FIG. 21C show beam pattern augmentations producing unique and useful gain patterns using a binary logic approach to beam pattern augmentation in accordance with the present invention.
Figure 21B:
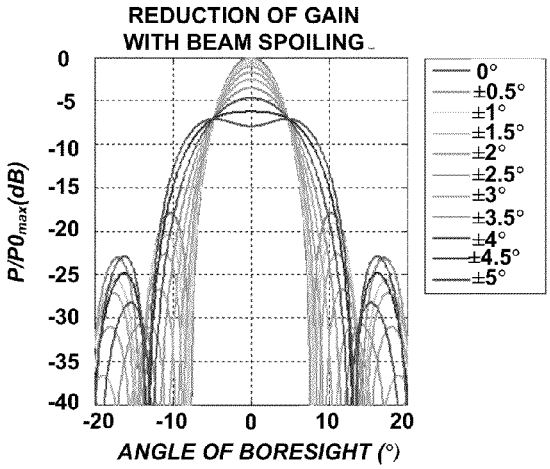
Figure 21C:
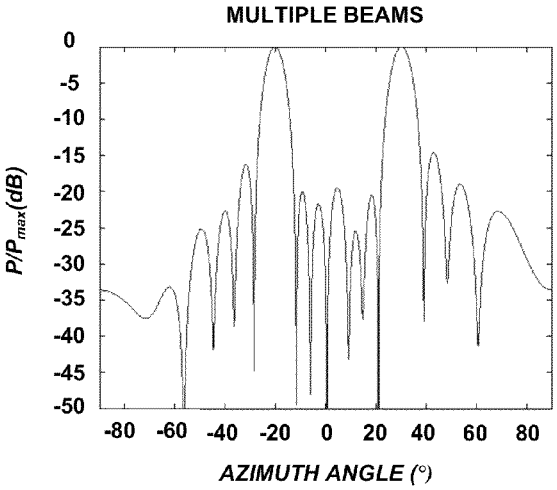

FIG. 21A-FIG. 21C show beam pattern augmentations producing unique and useful gain patterns using a binary logic approach to beam pattern augmentation in accordance with the present invention. Additional patterns are shown in FIG. 22A-FIG. 35.

Figure 22A:
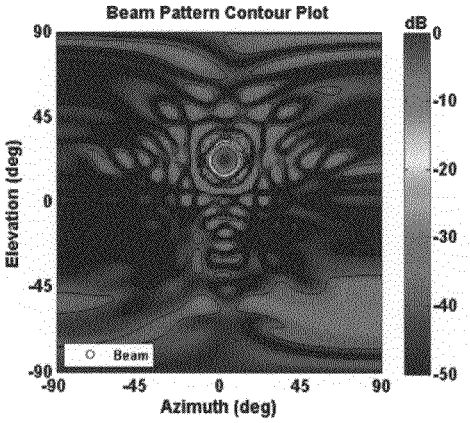
FIG. 22A-FIG. 35 show beam pattern augmentations producing unique and useful gain patterns using a binary logic approach to beam pattern augmentation in accordance with the present invention additional to those presented in FIG. 21A-FIG. 21C.
Figure 22B:
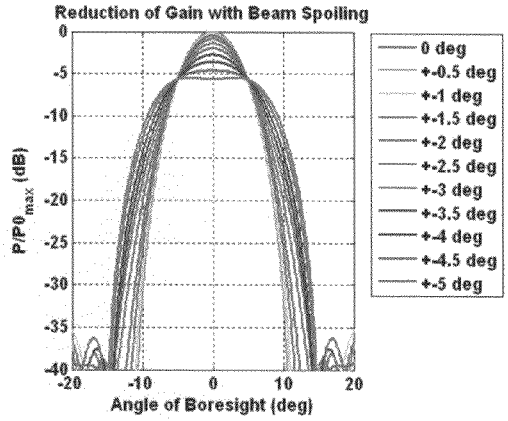
Figure 22C:
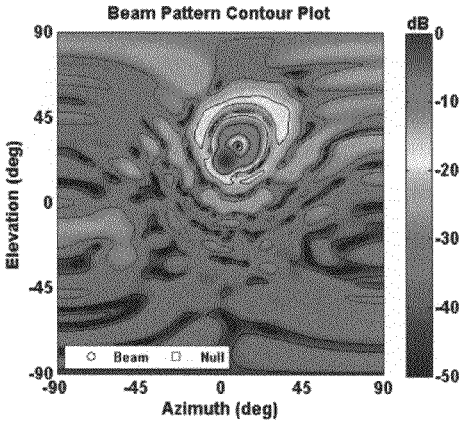
Figure 22D:
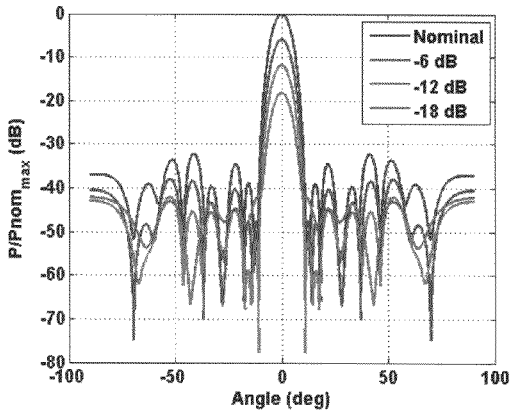

FIG. 22A-FIG. 22D graphically illustrate the substantial beam forming capabilities of the present invention wherein FIG. 22A depicts precise beam steering, FIG. 22B graphs beam spoiling, FIG. 22C depicts simultaneous beam and null casting, and FIG. 22D graphs adaptive gain control.

Figure 23A:
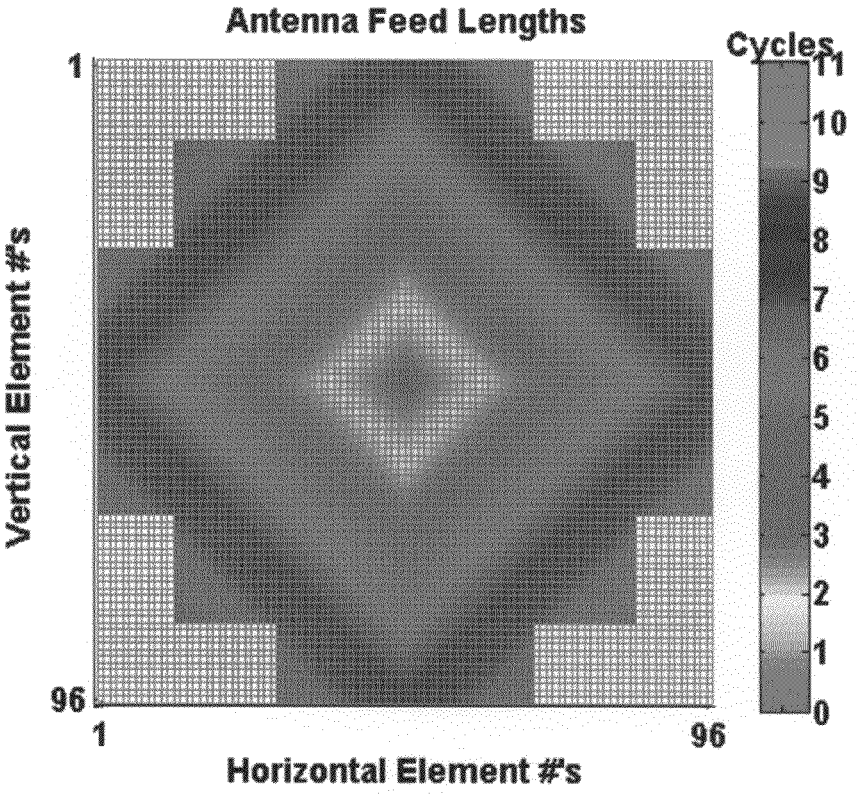
Figure 23B:
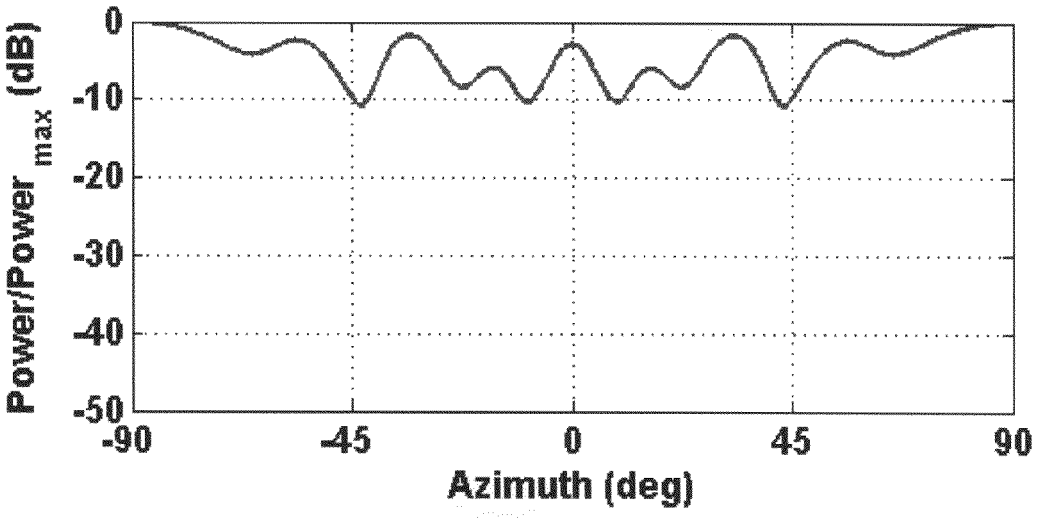
Figure 24A:
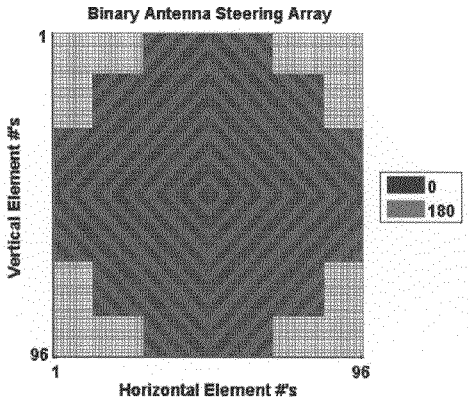
Figure 24B:
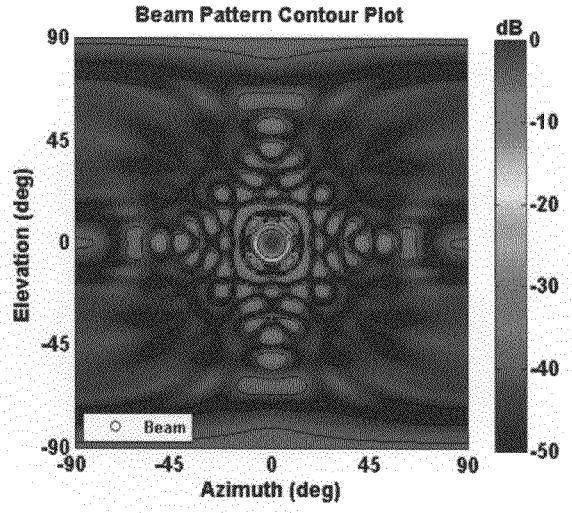
Figure 24C:
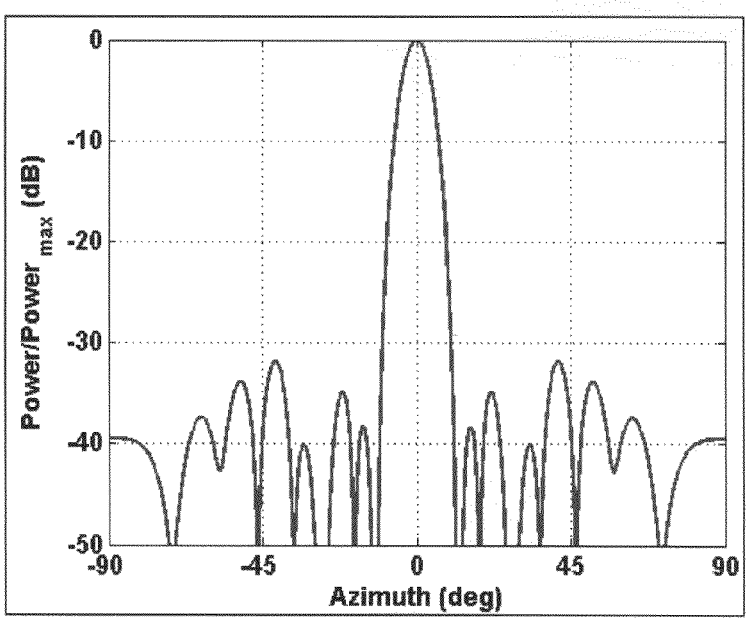
Figure 24C:
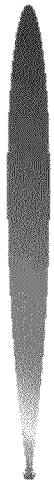
Figure 24D:
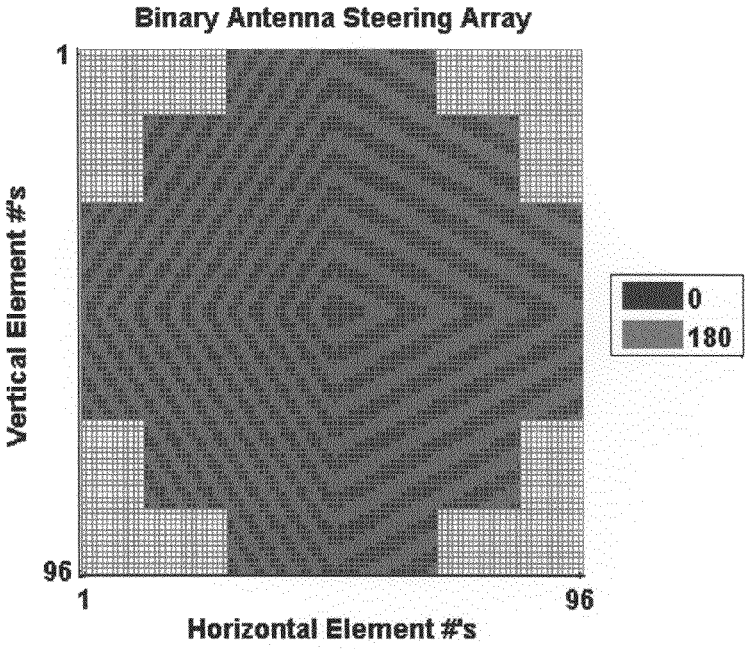
Figure 24E:
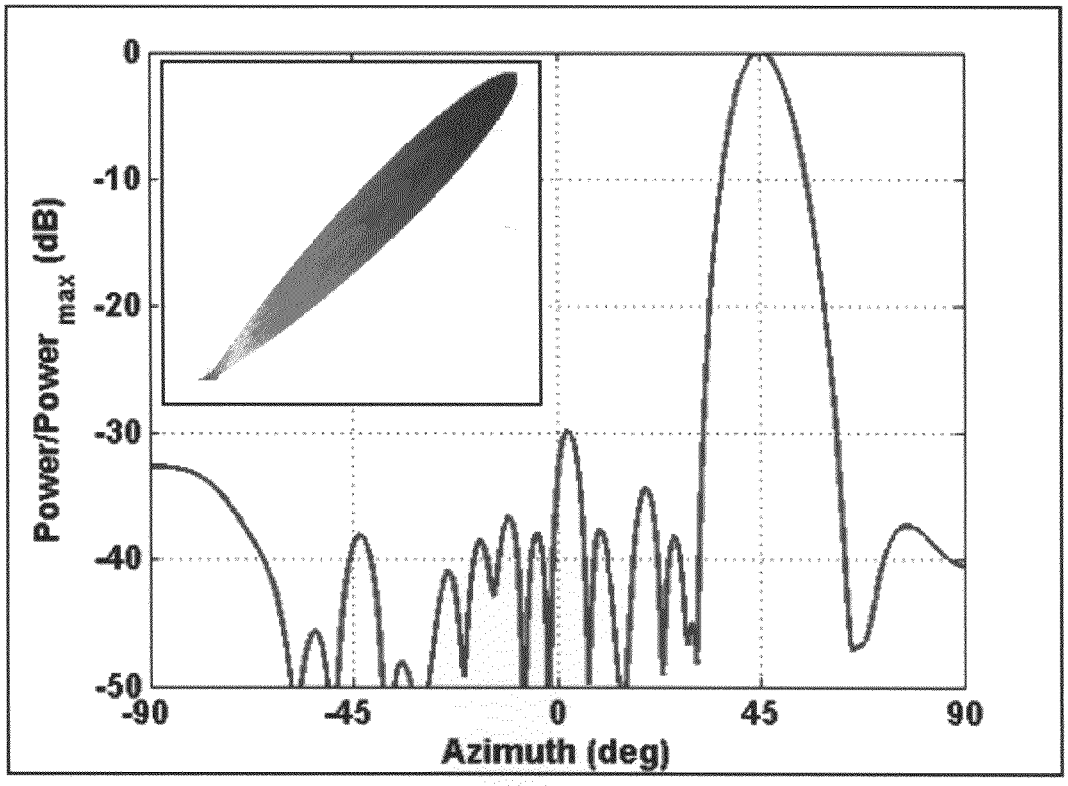

FIG. 23A-FIG. 23B depict the antenna feed structure and graph the power loss of an active electronically scanned array ("AESA") in accordance with the present invention having 7104 1-Bit Phase Shifters, at 1/10 spacing, a 3.5" aperture, at 35 GHz, with an 8.57-mm wavelength, and $\cos^2$ on a pedestal tapering; with all phase shifters at 0 and no main beam, there is a −85 dB power loss.

FIG. 24A-FIG. 24E illustrate how a beam may be formed and steered by aligning phases in a desired direction.

Figure 25A:
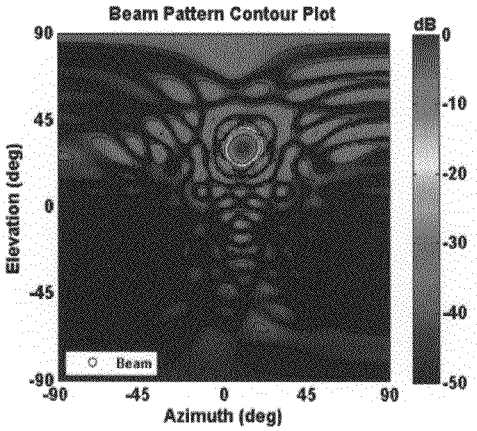
Figure 25B:
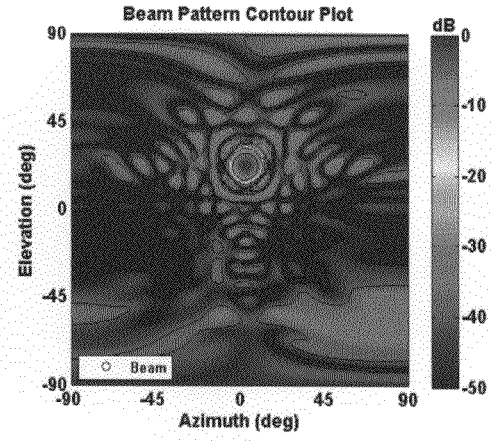
Figure 25C:
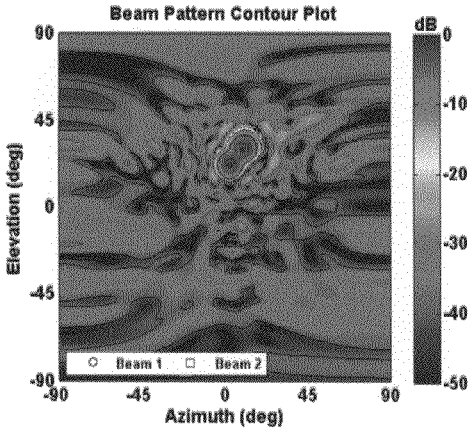
Figure 25D:
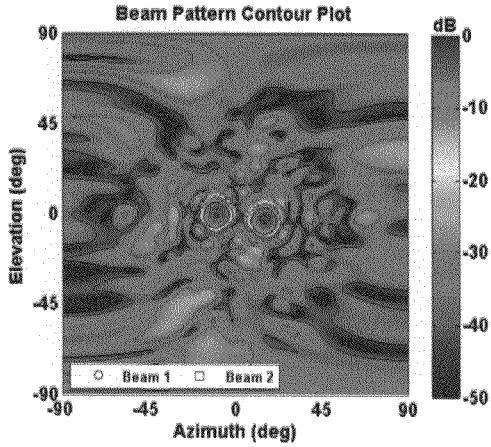

FIG. 25A-FIG. 25D illustrate how the beams of FIG. 25A-FIG. 25B may be spoiled in FIG. 25C through combination of two separate beams; and steered independently in FIG. 25D.

Figure 26A:
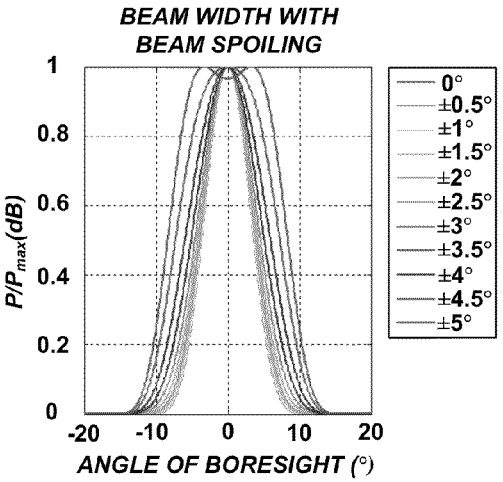
Figure 26B:
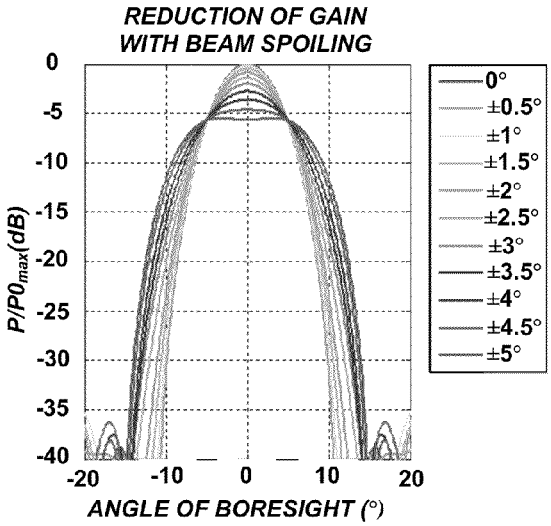
Figure 26C:
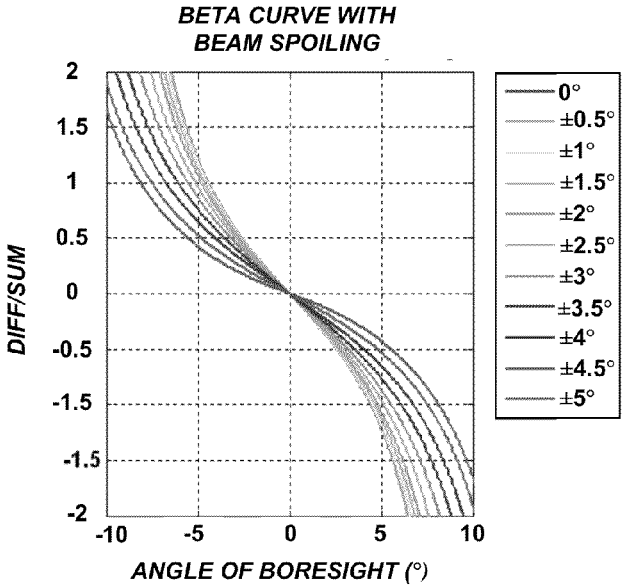

FIG. 26A-FIG. 26C graph the beam width at 7.2°-16.6° beamwidths, the slight gain reduction, and the $\Delta/\Sigma$ slope variation in the beta curve of a beam pattern with beam spoiling.

Figure 27:
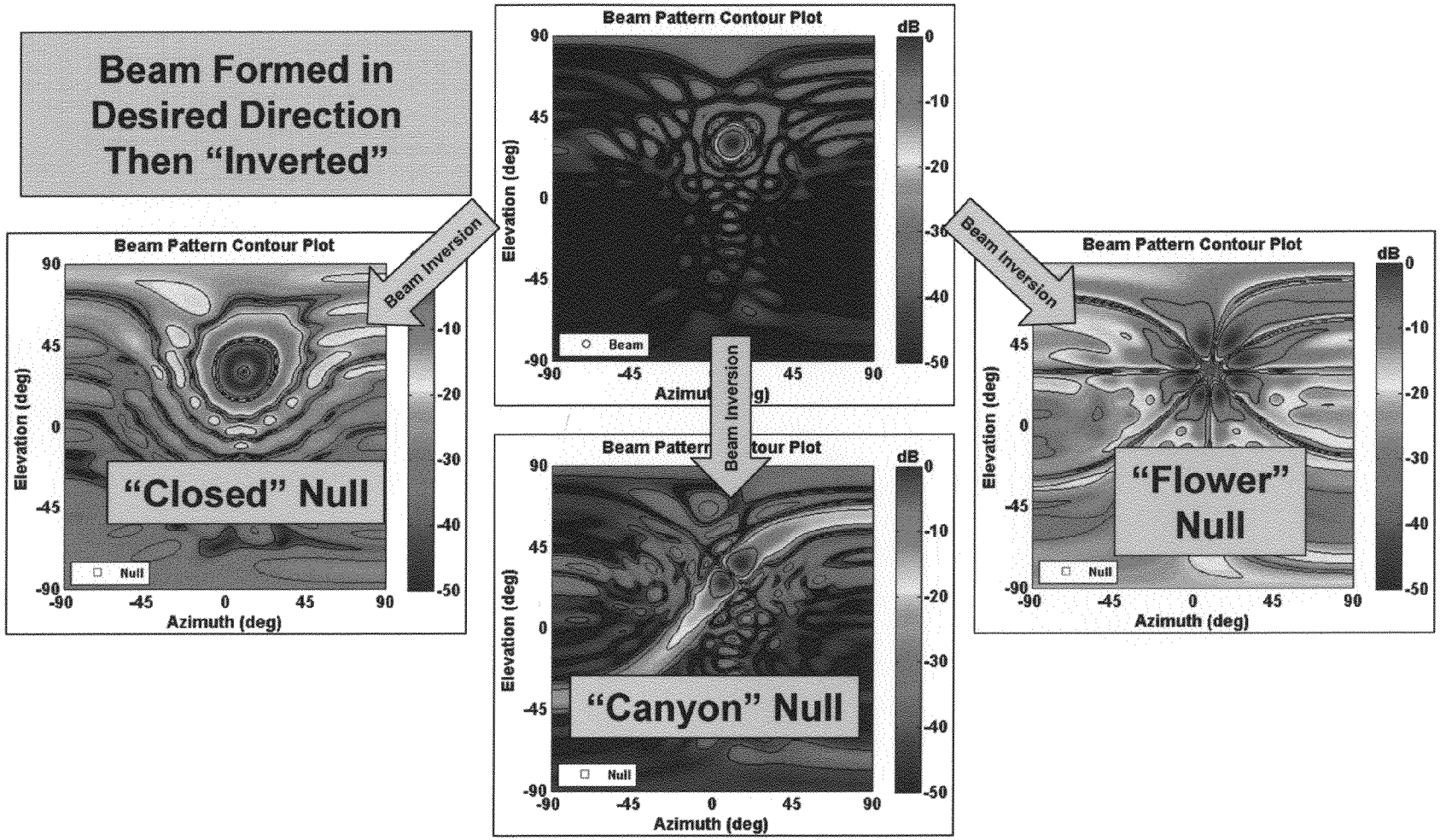

FIG. 27 graphically illustrates how the present invention may be used to form and steer various types of nulls.

Figure 28:
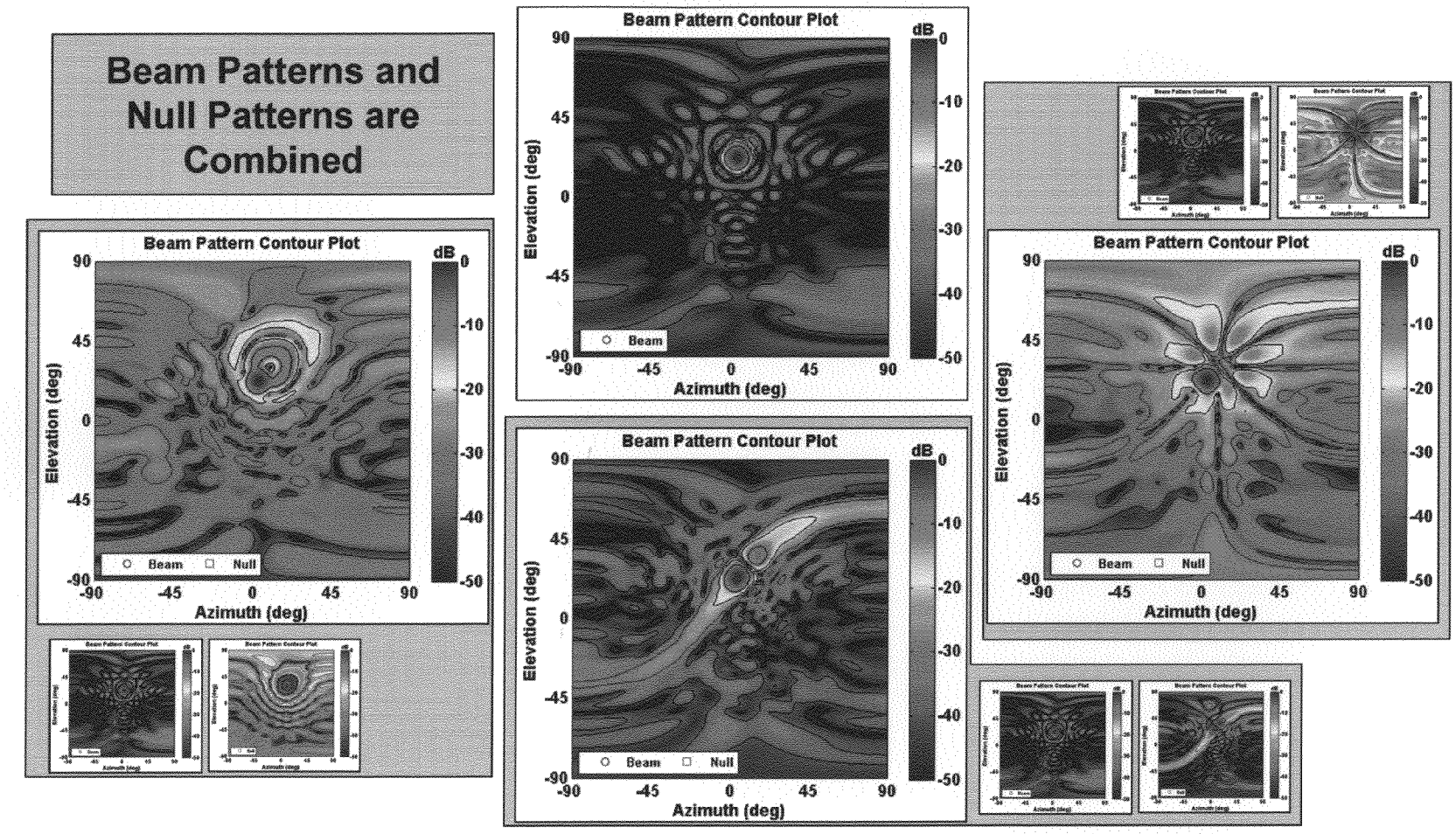

FIG. 28 graphically illustrates how the present invention may be used to independently form and steer beams and nulls.

Figure 29A:
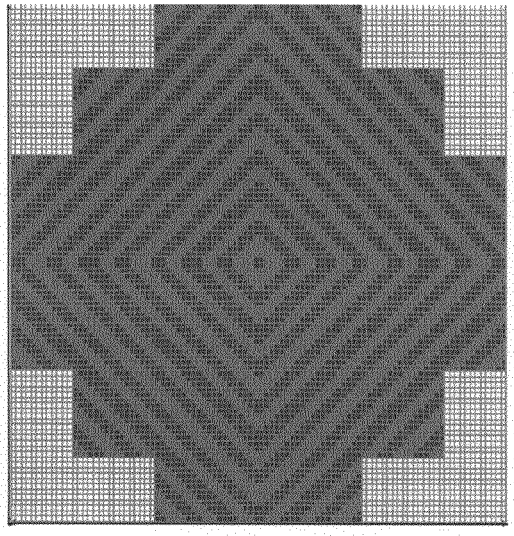
Figure 29B:
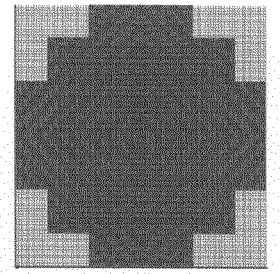
Figure 29C:
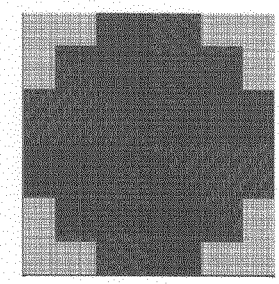
Figure 29D:
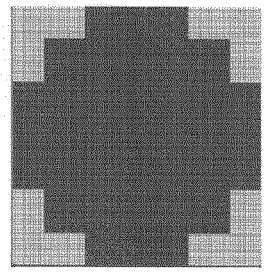
Figure 29E:
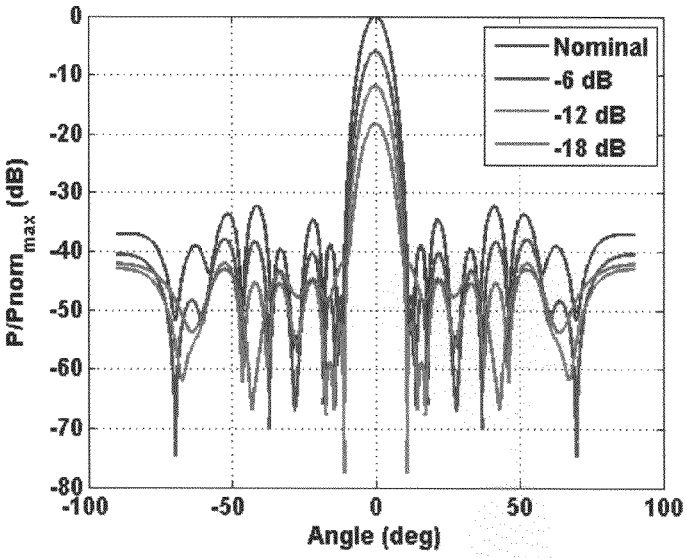
Figure 30A:
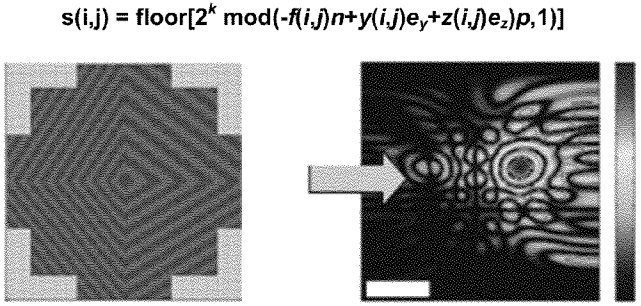
Figure 30C:
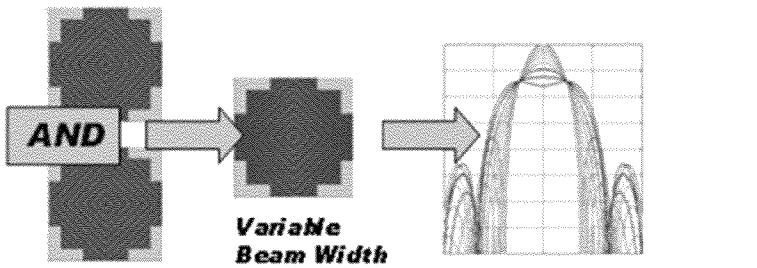
Figure 30B:
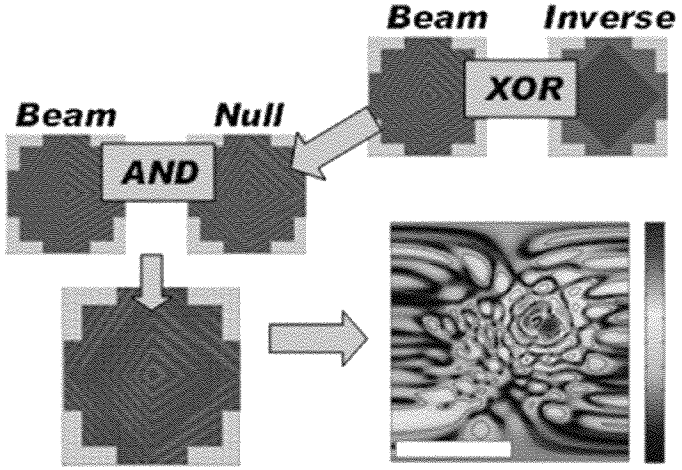
Figure 30D:
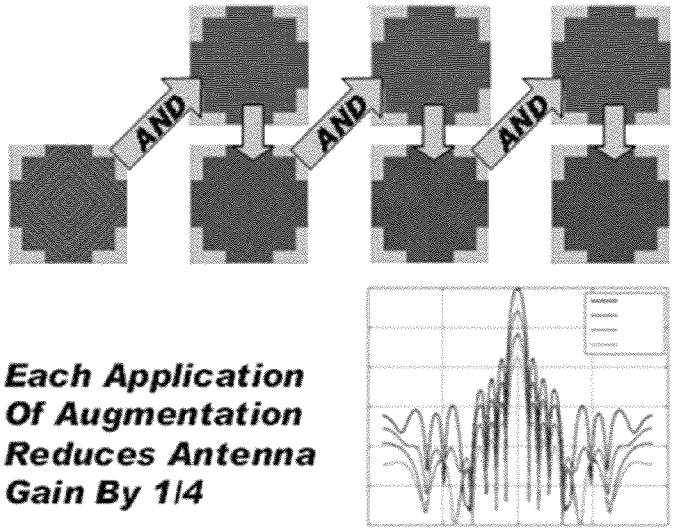

FIG. 29A-FIG. 29E illustrates how the present invention can be used for adaptive gain control in which FIG. 29A depicts a nominal beam steering pattern, FIG. 29B-FIG. 29D depict deconstructive interference, and FIG. 29E graphs successive ¼ power reductions.

FIG. 30A-FIG. 30D graphically illustrate how Simple Binary Logic Combined with Beam Steering Arrays in accordance with the present invention provides substantial beam forming capabilities.

Figure 31:
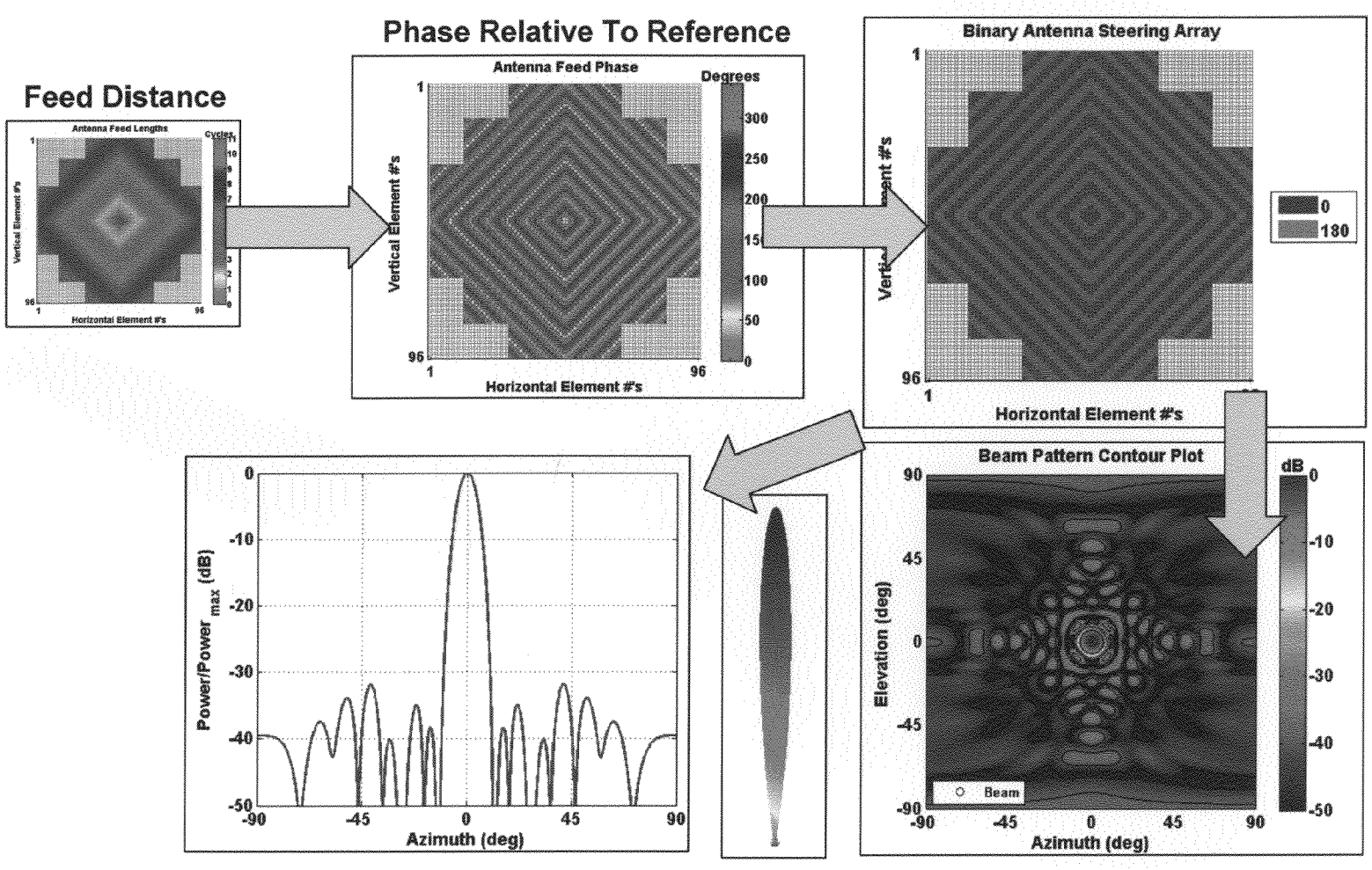

FIG. 31 graphically illustrates beam forming through alignment of phases.

Figure 32:
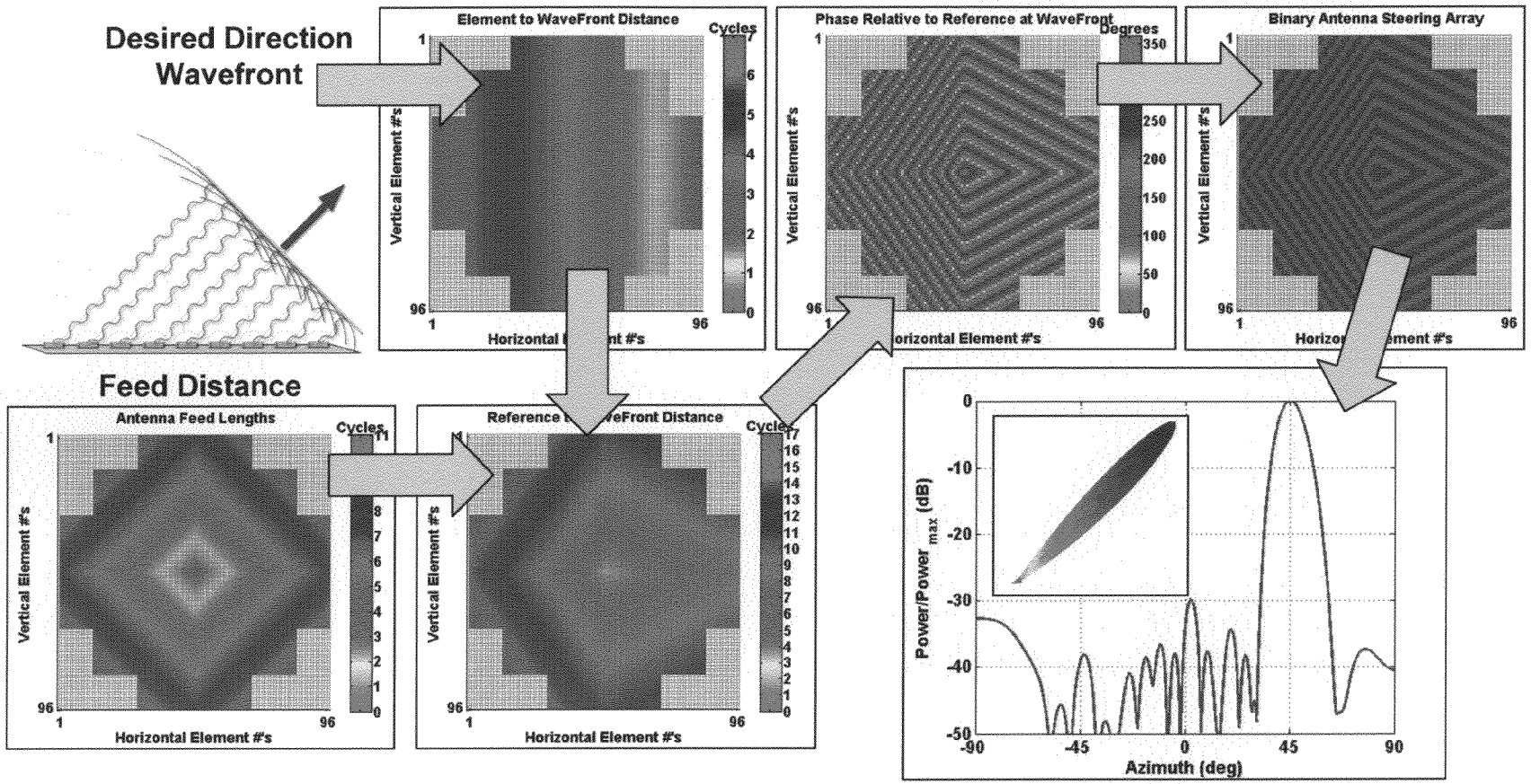

FIG. 32 graphically illustrates beam steering.

Figure 33:
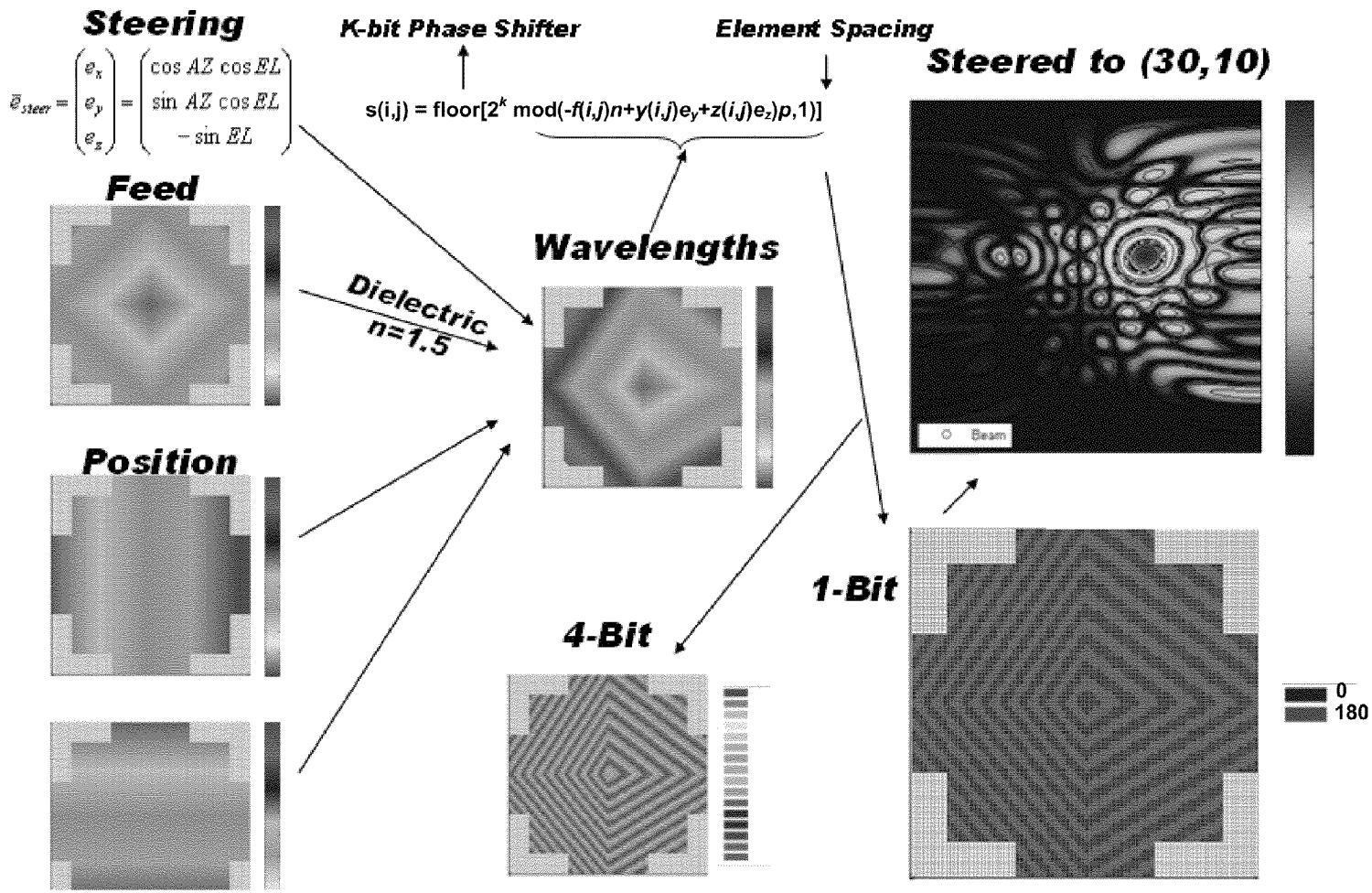

FIG. 33 graphically illustrates one particular beam steering technique.

Figure 34:
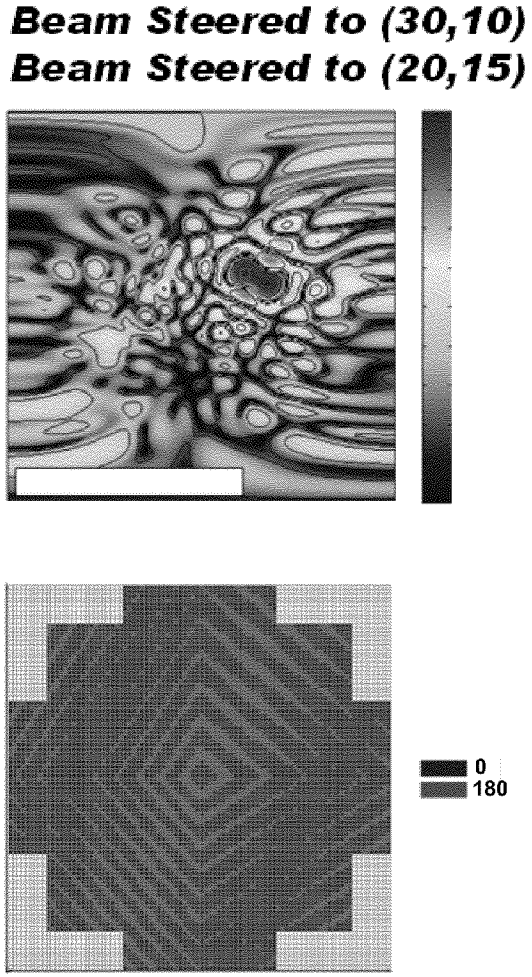
Figure 34:
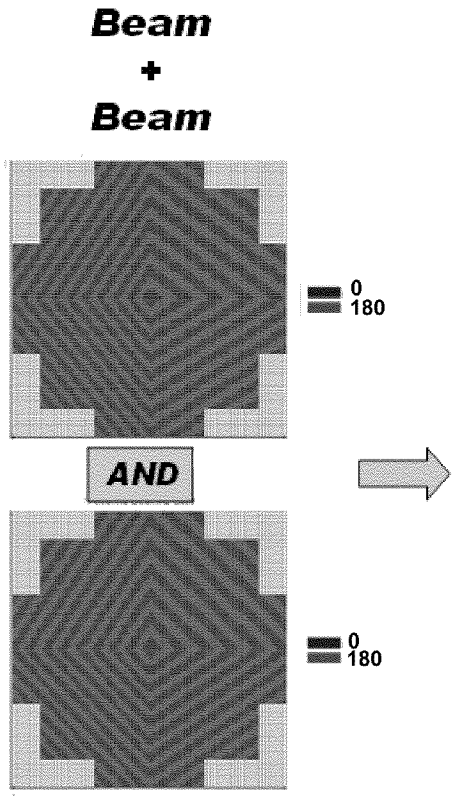

FIG. 34 graphically illustrates one particular technique for casting multiple beams.

Figure 35:
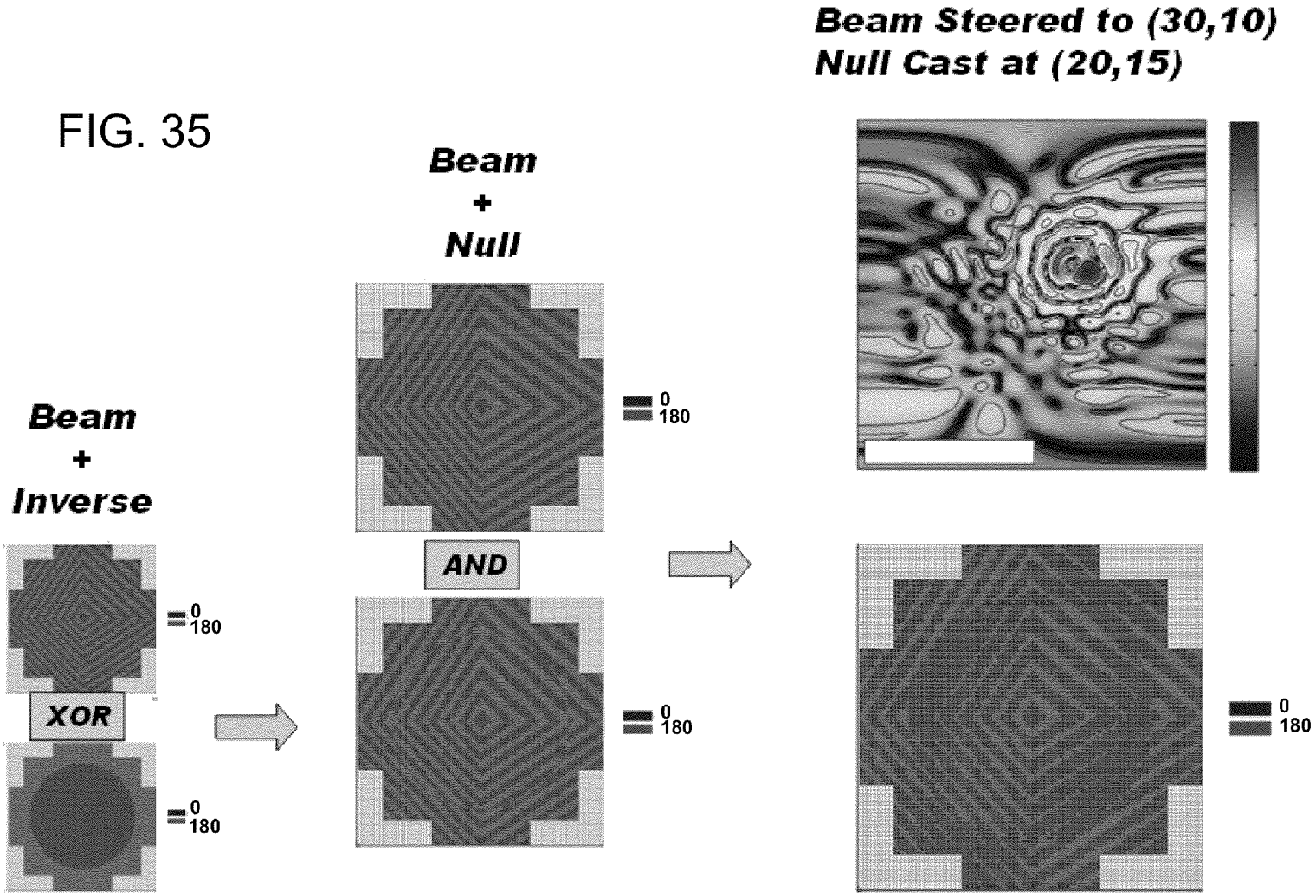

FIG. 35 graphically illustrates one technique for adaptive processing.

Note further that, although the illustrated embodiments all employ and electromagnetic beam, the same principles will also work with acoustic beams. An example of an acoustic application would be, e.g., SONAR. The adaptation of the principles taught herein will be well within the ordinary skill in the art given the present disclosure. Accordingly, the present invention is not limited to electromagnetic beams.

As was mentioned above, the nominal and augmentation patterns are combined using AND, OR and XOR binary operations to determine the beam steering pattern. Those skilled in the art having the benefit of this disclosure will appreciate that these binary operations are performed electronically, either in hardware, in software, or in some combination of the two. The conventional approach of generating multiple beams that constructively and destructively with each other to define a gain pattern does not operate in binary fashion, or even in digital fashion. It is, rather, a classic analog interaction between or among the multiple beams.

Figure 36:
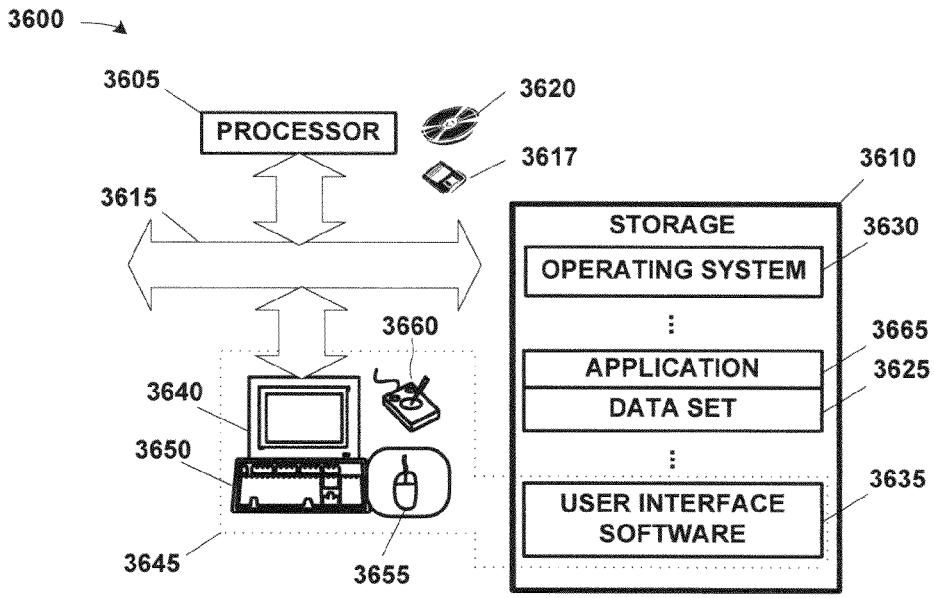
FIG. 36 shows selected portions of the hardware and software architecture of a computing apparatus such as may be employed in some aspects of the present invention.

Various embodiments of the present invention therefore include a computing apparatus of some kind, such as that conceptually illustrated in FIG. 36. FIG. 36 shows selected portions of the hardware and software architecture of a computing apparatus 3600 such as may be employed in some aspects of the present invention. The computing apparatus 3600 includes a processor 3605 communicating with storage 3610 over a bus system 3615. The storage 3610 may include a hard disk and/or random access memory ("RAM") and/or removable storage such as a floppy magnetic disk 3617 and an optical disk 3620.

The storage 3610 is encoded with a data set 3625. The content of the data set 3625 will be implementation specific. For example, in some embodiments, it may comprise data acquired for purposes of locating a jamming source or some other source of interference over which a null may be cast. In some embodiments, it may comprises a library of predetermined augmentation patterns. In still other embodiments, the data set 3625 may even be omitted.

The storage 3610 is also encoded with an operating system 3630, user interface software 3635, and an application 3665. The operating system 3630 may be any suitable operating system known to the art. The user interface software 3635, in conjunction with a display 3640, implements a user interface 3645. The user interface 3645 may include peripheral I/O devices such as a keypad or keyboard 3650, a mouse 3655, or a joystick 3660. Note that the all or part of the user interface 3645 may be omitted in various alternative embodiments. The application 3665 may be coded in any suitable programming language known to the art.

The processor 3605 runs under the control of the operating system 3630. The processor 3605 may be any suitable processor known to the art, such as a controller or a general purpose microprocessor. However, many embodiments may be operated in environments in which relatively large amounts of information are processed in relatively short periods of time. These embodiments may opt for processors such as digital signal processors ("DSPs") designed for such tasks. Some embodiments may also implement the processor 3605 as a processor set, e.g., a microprocessor and a math coprocessor.

The application 3665 is invoked by the operating system 3630 upon power up, reset, or both, depending on the implementation of the operating system 3630. The user may also alternatively invoke the application through the user interface 3645. The application 3665, when invoked, performs the method of the present invention.

Note that there is no need for the data set 3625 to reside on the same computing apparatus 3600 as the application 3665 by which it is processed. Some embodiments of the present invention may therefore be implemented on a computing system, e.g., the computing system 3700 in FIG. 37, comprising more than one computing apparatus. For example, the data set 3625 may reside in a data structure residing on a server 3703 and the application 3665' by which it is processed on a workstation 3706 where the computing system 3700 employs a networked client/server architecture.

However, there is no requirement that the computing system 3700 be networked. Alternative embodiments may employ, for instance, a peer-to-peer architecture or some hybrid of a peer-to-peer and client/server architecture. The size and geographic scope of the computing system 3700 is not material to the practice of the invention. The size and scope may range anywhere from just a few machines of a Local Area Network ("LAN") located in the same room to many hundreds or thousands of machines globally distributed in an enterprise computing system.

As is apparent from the above discussion, some portions of the detailed descriptions herein are consequently presented in terms of a software implemented process involving symbolic representations of operations on data bits within a memory in a computing system or a computing device. These descriptions and representations are the means used by those in the art to most effectively convey the substance of their work to others skilled in the art. The process and operation require physical manipulations of physical quantities. Usually, though not necessarily, these quantities take the form of electrical, magnetic, or optical signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated or otherwise as may be apparent, throughout the present disclosure, these descriptions refer to the action and processes of an electronic device, that manipulates and transforms data represented as physical (electronic, magnetic, or optical) quantities within some electronic device's storage into other data similarly represented as physical quantities within the storage, or in transmission or display devices. Exemplary of the terms denoting such a description are, without limitation, the terms "processing," "computing," "calculating," "determining," "displaying," and the like.

Note also that the software implemented aspects of the invention are typically encoded on some form of program storage medium or implemented over some type of transmission medium. The program storage medium may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The invention is not limited by these aspects of any given implementation.

As is noted above, one of the advantages that many embodiments of the present invention will manifest is that it will reduce the amount of information processing using only a single antenna. Adaptive processing algorithms are currently used in many instances to remove the effects of interference from acquired data. The adaptive processing algorithms essentially impose a "virtual null" in the data to remove the pernicious effects of the interference. The algorithms are iterative, and so are computationally intensive. This is particularly true of situations in which large volumes of data are present.

However, in one aspect, the present invention independently steers a beam and a null (or multiple nulls) so that the desired information can still be acquired while casting the null over the source of undesirable interference. The null is essentially a "cone of silence" that eliminates the interference from the return. Consequently, the acquired data will require little or no processing to eliminate the noise caused by the interference.

Figure 38:
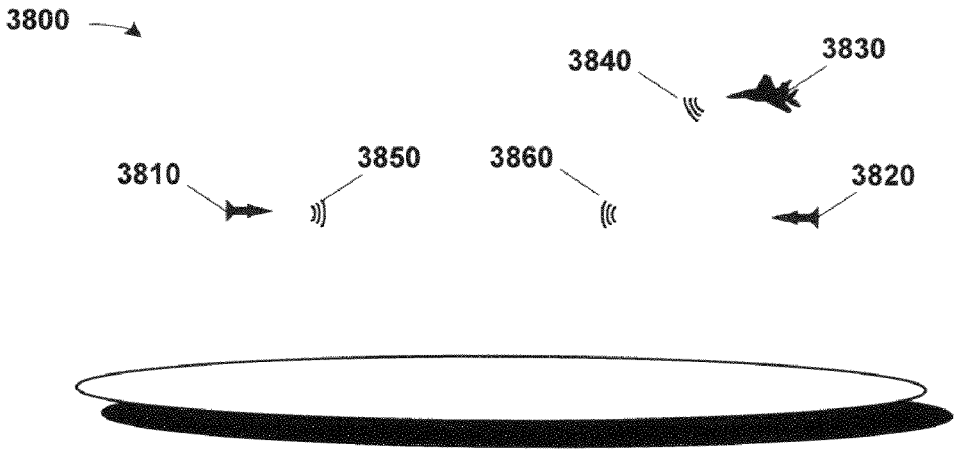
FIG. 38 depicts a conceptualized scenario illustrated in which an interceptor realizes selected benefits of the present invention as it seeks to intercept a target in the presence of interference from a jammer.

Consider for example, the conceptualized scenario 3800 illustrated in FIG. 38, in which an interceptor 3810 seeks to intercept a target 3820 in the presence of interference from a jammer 3830. The interceptor 3810 can detect and locate the source of the jamming signal 3840 using any technique known to the art. The interceptor 3810 employs a variation (not shown) of the computing apparatus 3600, shown in FIG. 36 that then generates a beam pattern for the RADAR signal 3850 as described above that projects a beam onto the target 3820 while casting a null over the jammer 3830. The beam pattern can then be transmitted to the antenna—e.g., the antenna shown in FIG. 16A-FIG. 20 and described in associated text. The antenna can then translate the beam pattern into phase command for the elements of the antenna to implement the beam pattern.

The null cast over the jammer 3830 means that the data acquired from the return 3860 will be relatively free of the interference from the jamming signal 3840. The computing apparatus can therefore omit all, or at least most, of the iterative adaptive computing practiced in conventional approaches to achieve the same affect. This can be significant in this context because any or all of the interceptor 3810, the target 3820, and the jammer 3830 may be moving relative to one another at significantly high spends. The reduction in computing time permits the interceptor 3810 to more quickly adjust course to offset evasive maneuvers of the target 3820. Thus, in this particular embodiment, the invention provides a compact, high-speed, 1-bit phase interference method applied to phased array antennas allowing arbitrary placement, shape, size and intensity of one or multiple simultaneous beams and nulls dynamic in space and time.

Figure 39:
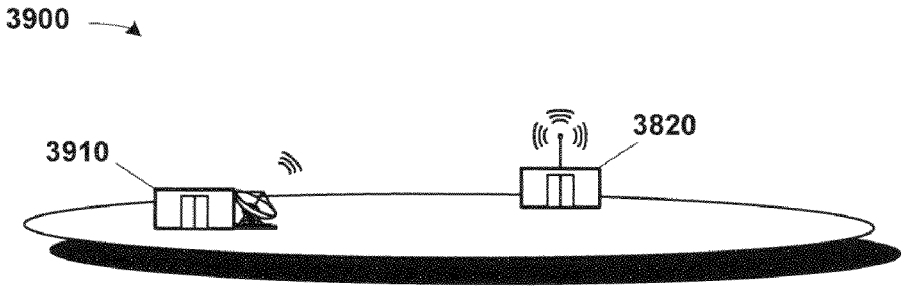
FIG. 39 depicts a conceptualized scenario in which a ground based RADAR station seeks to at least mitigate the interference from a source realizing selected benefits of the present invention.

Or, consider the scenario 3900 in FIG. 39, in which a ground based RADAR station 3910 seeks to at least mitigate the interference from a source 3910. In this scenario, the present invention is practiced in conjunction with conventional, post-acquisition adaptive computing algorithms. The station 3910 scans a large segment of the sky with a large antenna, and thereby acquires rather voluminous data. The RADAR signal 3930 that it transmits embodies a beam pattern that casts a null over the interference source 3910 as described above.

Figure 37:
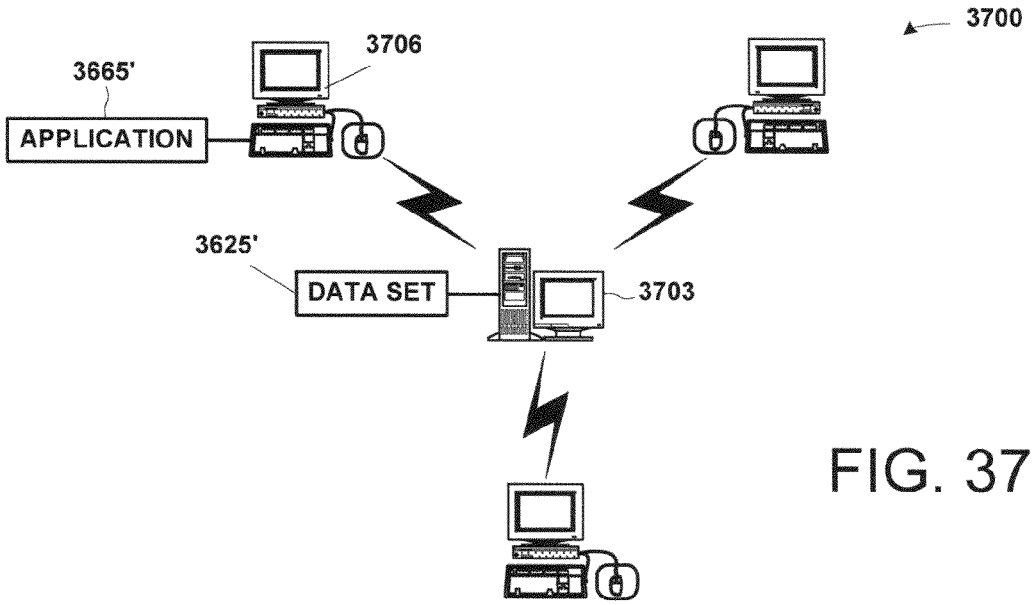
FIG. 37 illustrates a computing system on which some aspects of the present invention may be practiced in some embodiments.

A computing system such at the computing system 3700 shown in FIG. 37, which then processes the data. The null over the interference source 3910 at least mitigates the interference, thus greatly reducing the amount of post-acquisition processing. This will yield substantial benefits by reducing computing time and the consumption of computing resources.

Returning to the scenario of FIG. 38, other aspects of the present invention regarding gain control may also be illustrated. In the early stages of acquisition, the interceptor 3810 might wish to search at greater range, and therefore scan with field of view using a single, high gain beam. As the interceptor 3810 and target 3820 near one another, the interceptor 3810 might choose to spoil the beam as described above, which will reduce its gain but will cover a larger portion of the field of view. This would bring a concomitant reduction in scanning. Still further, as the interceptor 3810 and target 3820 continue to approach, the sensors of the interceptor 3810 might begin to saturate from the gain of the return signal. To compensate, the interceptor 3810 can then adaptively control the gain of the transmitted signal as described above to prevent such saturation.

Those in the art may also realize other benefits and advantages arising from the practice of the invention. Note, however, that not all embodiments will necessarily yield all, or the same, benefits and advantages described above or realized hereafter to the same degree. Indeed, some embodiments may actually not realize one or more of these advantages and benefits. Similarly, not all embodiments will manifest all aspects of the invention, or even the same aspects of the invention as are found in other embodiments.

The following documents are hereby incorporated by reference as if expressly set forth verbatim in this specification for the listed subject matter:

- U.S. application Ser. No. 11/956,825, entitled, "Directive Spatial Interference Beam Control", and filed Dec. 14, 2007, in the name of the inventor Scott J. Paynter;
- U.S. Provisional Application Ser. No. 60/882,049; entitled, "Directive Spatial Interference Beam Control"; filed Dec. 27, 2006, filed in the name of the inventors Scott J. Paynter; and U.S. patent application Ser. No. 11/421,504, entitled "Millimeter Wave Electronically Scanned Antenna", filed Jun. 1, 2006, in the name of: Cole A. Chandler.

This concludes the detailed description. The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A computer-implemented method for use in controlling a beam, comprising:

determining a nominal beam pattern;

determining an augmentation pattern; and combining the nominal beam pattern with the augmentation pattern to generate a beam steering pattern, the combining occurring before the beam is transmitted;

wherein the determining of the nominal and augmentation patterns and the combining are performed by a computing device and combining the nominal and augmentation patterns simultaneously and independently steers a beam and a null in the beam steering pattern.

2. The computer-implemented method of claim 1, wherein combining the nominal and augmentation patterns includes combining them through a binary operation.

3. The computer-implemented method of claim 1, wherein combining the nominal and augmentation patterns adaptively controls the gain of the beam in the beam steering pattern.

4. The computer-implemented method of claim 1, wherein combining the nominal and augmentation patterns spoils a beam in the beam steering pattern.

5. The computer-implemented method of claim 1, wherein combining the nominal and augmentation patterns converts a beam to a null in the beam steering pattern.

6. A program storage medium encoded with instructions that, when executed by a computing device, perform a computer-implemented method for use in controlling a beam, the method comprising:

determining a nominal beam pattern;

determining an augmentation pattern; and combining the nominal beam pattern with the augmentation pattern to generate a beam steering pattern, the combining occurring before the beam is transmitted;

wherein combining the nominal and augmentation patterns simultaneously and independently steers a beam and a null in the beam steering pattern.

7. The program storage medium of claim 6, wherein combining the nominal and augmentation patterns includes combining them through a binary operation.

8. The program storage medium of claim 6, wherein combining the nominal and augmentation patterns adaptively controls the gain of the beam in the beam steering pattern.

9. The program storage medium of claim 6, wherein combining the nominal and augmentation patterns spoils a beam in the beam steering pattern.

10. The program storage medium of claim 6, wherein combining the nominal and augmentation patterns converts a beam to a null in the beam steering pattern.

11. A computing apparatus for use in controlling a beam, comprising:

a processor;

a bus system;

a storage; and software residing on the storage that, when invoked by the processor over the bus system, performs a method comprising:

determining a nominal beam pattern;

determining an augmentation pattern; and combining the nominal beam pattern with the augmentation pattern to generate a beam steering pattern, the combining occurring before the beam is transmitted;

wherein combining the nominal and augmentation patterns simultaneously and independently steers a beam and a null in the beam steering pattern.

12. The computing apparatus of claim 11, wherein combining the nominal and augmentation patterns includes combining them through a binary operation.

13. The computing apparatus method of claim 11, wherein combining the nominal and augmentation patterns adaptively controls the gain of the beam in the beam steering pattern.

14. The computing apparatus method of claim 11, wherein combining the nominal and augmentation patterns spoils a beam in the beam steering pattern.

15. The computing apparatus method of claim 11, wherein combining the nominal and augmentation patterns converts a beam to a null in the beam steering pattern.

16. A computer-implemented method for controlling a beam, comprising:

determining a delay pattern for a plurality of signals emanating from a respective plurality of radiating elements in a phased array; and generating the signals to create a beam steering pattern resulting from the delay pattern to simultaneously and independently steer a beam and a null in a single beam.

17. The computer-implemented method of claim 16, wherein determining the delay pattern includes rounding down from the modulus of a selection function.

18. The computer-implemented method of claim 16, wherein determining the delay pattern includes setting the delay for approximately half the radiating elements to 0° and the delay for the remainder of the radiating elements to 180°.

19. The computer-implemented method of claim 16, wherein determining the delay pattern includes setting the delay for half the radiating elements to 0° and the delay for the other half the radiating elements to 180°.

20. A method for steering a beam, comprising:

determining a nominal beam pattern defining a beam;

augmenting the nominal beam pattern to produce a beam steering pattern defining a null independently of the defined beam; and generating a phase shifted beam manifesting the beam steering pattern that simultaneously and independently steers the beam and the null;

wherein the determining and augmenting are performed by a computing device and the augmenting occurs prior to the generating.

21. The method of claim 20, wherein augmenting the nominal beam pattern includes:

selecting a steering operator;

generating an augmentation pattern from the steering operator; and overlaying the augmentation pattern on the nominal beam pattern.

22. The method of claim 20, wherein augmenting the nominal beam pattern spoils the beam.

23. The method of claim 20, wherein augmenting the nominal beam pattern includes adaptively controlling the gain of the beam.

24. The method of claim 20, wherein augmenting the nominal beam pattern steers nulls in the resultant beam steering pattern.

25. The method of claim 20, wherein augmenting the nominal beam pattern converts the beam to a null.

26. A method for use in controlling a beam, comprising:
determining the phase shift in each element of a phased array to simultaneously and independently form, steer and combine a set of beam shapes into a single beam pattern defining a beam and a null; and
applying the delay or phase shift to simultaneously and independently steer the beam and the null in a single beam.

27. The method of claim 26, wherein applying the delay or phase shift includes combining a beam with a controlled second beam.

28. The method of claim 26, wherein applying the delay or phase shift includes converting the steered beam into a steered null.

29. The method of claim 26, wherein applying the delay or phase shift includes adaptively controlling the gain of the resulting steered beam.

30. The method of claim 26, wherein applying the delay or phase shift with the beam spoils the beam.

31. A method for use in steering a beam, comprising:
determining a nominal beam pattern defining a beam;
augmenting the nominal beam pattern to adaptively control the gain in a beam steering pattern; and
generating a phase shifted beam manifesting the beam steering pattern;
wherein the determining and augmenting are performed by a computing device and the augmenting is performed prior to the generating and augmenting the nominal beam pattern steers nulls in the resultant beam steering pattern.

32. The method of claim 31, wherein augmenting the nominal beam pattern includes:
selecting a steering operator;
generating an augmentation pattern from the steering operator; and
overlaying the augmentation pattern on the nominal beam pattern.

33. The method of claim 31, wherein determining the delay pattern includes setting the delay for approximately half the radiating elements to 0° and the delay for the remainder of the radiating elements to 180°.

34. The method of claim 31, wherein determining the delay pattern includes setting the delay for half the radiating elements to 0° and the delay for the other half the radiating elements to 180°.

35. A method for use in steering a beam, comprising:
determining a nominal beam pattern defining a beam;
augmenting the nominal beam pattern to invert the beam to a null in a resulting beam steering pattern; and
generating a phase shifted beam manifesting the beam steering pattern
wherein the augmenting occurs prior to the generating.

36. The method of claim 35, wherein augmenting the nominal beam pattern includes:
selecting a steering operator;
generating an augmentation pattern from the steering operator; and
overlaying the augmentation pattern on the nominal beam pattern.

37. The method of claim 35, wherein determining the delay pattern includes setting the delay for approximately half the radiating elements to 0° and the delay for the remainder of the radiating elements to 180°.

38. The method of claim 35, wherein determining the delay pattern includes setting the delay for half the radiating elements to 0° and the delay for the other half the radiating elements to 180°.

39. A method for use in steering a beam, comprising:
determining a nominal beam pattern defining a beam;
augmenting the nominal beam pattern to spoil the beam in a beam steering pattern; and
generating a phase shifted beam manifesting the beam steering pattern
wherein the augmenting occurs prior to the generating and augmenting the nominal beam pattern steers nulls in the resultant beam steering pattern.

40. The method of claim 39, wherein augmenting the nominal beam pattern includes:
selecting a steering operator;
generating an augmentation pattern from the steering operator; and
overlaying the augmentation pattern on the nominal beam pattern.

41. The method of claim 39, wherein determining the delay pattern includes setting the delay for approximately half the radiating elements to 0° and the delay for the remainder of the radiating elements to 180°.

42. The method of claim 39, wherein determining the delay pattern includes setting the delay for half the radiating elements to 0° and the delay for the other half the radiating elements to 180°.

43. A method comprising:
locating a source of interference;
determining a beam steering pattern that will simultaneously and independently cast a null over the source of interference while steering a beam in the direction of a target; and
generating a signal manifesting the beam steering pattern.

44. The method of claim 43, wherein determining the beam steering pattern includes:
determining a nominal beam pattern defining a beam; and
independently of the defined beam.

45. The method of claim 43, wherein determining the beam steering pattern includes:
selecting a steering operator;
generating an augmentation pattern from the steering operator; and
overlaying the augmentation pattern on the nominal beam pattern.

46. The method of claim 43, further comprising determining a second beam steering pattern in which the beam is spoiled.

47. The method of claim 43, further comprising determining a second beam steering pattern in which the gain of the beam is adaptively controlled.

48. An interceptor, comprising:
a computing apparatus, including:
a processor;
a bus system;
a storage;
software residing on the storage that, when invoked by the processor over the bus system, performs a method comprising:
locating a source of interference;
determining a beam steering pattern for a single beam that will simultaneously and independently cast a null over the source of interference while steering the beam in the direction of a target; and generating a signal manifesting the beam steering pattern, the generating occurring after the determining; and a phased array antenna through which the signal is generated and transmitted.

49. The interceptor of claim 48, wherein determining the beam steering pattern includes:

determining a nominal beam pattern defining a beam; and augmenting the nominal beam pattern to produce a beam steering pattern defining a null independently of the defined beam.

50. The interceptor of claim 48, wherein determining the beam steering pattern includes:

selecting a steering operator;

generating an augmentation pattern from the steering operator; and overlaying the augmentation pattern on the nominal beam pattern.

51. The interceptor of claim 48, further comprising determining a second beam steering pattern in which the beam is spoiled.

52. The interceptor of claim 48, further comprising determining a second beam steering pattern in which the gain of the beam is adaptively controlled.

53. A computer-implemented method for use in controlling a beam, comprising:

determining a nominal beam pattern;

determining an augmentation pattern; and combining the nominal beam pattern with the augmentation pattern to generate a beam steering pattern, the combining occurring before the beam is transmitted;

wherein the determining of the nominal and augmentation patterns and the combining are performed by a computing device and combining the nominal and augmentation patterns converts a beam to a null in the beam steering pattern.

54. The computer-implemented method of claim 53, wherein combining the nominal and augmentation patterns includes combining them through a binary operation.

55. The computer implemented method of claim 53, wherein combining the nominal and augmentation patterns adaptively controls the gain of the beam in the beam steering pattern.

56. The computer implemented method of claim 53, wherein combining the nominal and augmentation patterns spoils a beam in the beam steering pattern.

57. A program storage medium encoded with instructions that, when executed by a computing device, perform a computer-implemented method for use in controlling a beam, the method comprising:

determining a nominal beam pattern;

determining an augmentation pattern; and combining the nominal beam pattern with the augmentation pattern to generate a beam steering pattern, the combining occurring before the beam is transmitted;

wherein combining the nominal and augmentation patterns converts a beam to a null in the beam steering pattern.

58. The program storage medium of claim 57, wherein combining the nominal and augmentation patterns includes combining them through a binary operation.

59. The program storage medium of claim 57, wherein combining the nominal and augmentation patterns adaptively controls the gain of the beam in the beam steering pattern.

60. The program storage medium of claim 57, wherein combining the nominal and augmentation patterns spoils a beam in the beam steering pattern.

61. A computer-implemented method for use in controlling a beam, comprising:

a processor;

a bus system;

a storage; and software residing on the storage that, when invoked by the processor over the bus system, performs a method comprising:

determining a nominal beam pattern;

determining an augmentation pattern; and combining the nominal beam pattern with the augmentation pattern to generate a beam steering pattern, the combining occurring before the beam is transmitted;

wherein combining the nominal and augmentation patterns spoils a beam in the beam steering pattern.

62. The computing apparatus of claim 61, wherein combining the nominal and augmentation patterns includes combining them through a binary operation.

63. The computing apparatus method of claim 61, wherein combining the nominal and augmentation patterns adaptively controls the gain of the beam in the beam steering pattern.

64. The computing apparatus method of claim 61, wherein combining the nominal and augmentation patterns spoils a beam in the beam steering pattern.

* * * * *